US010760191B2

(12) United States Patent
Takeuchi et al.

(10) Patent No.: US 10,760,191 B2
(45) Date of Patent: Sep. 1, 2020

(54) FRAME HOLDING DEVICE AND EMBROIDERY FRAME SET

(71) Applicant: BROTHER KOGYO KABUSHIKI KAISHA, Nagoya-shi, Aichi-ken (JP)

(72) Inventors: Kazuki Takeuchi, Nagoya (JP); Mitsuhiro Iida, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 185 days.

(21) Appl. No.: 16/139,864

(22) Filed: Sep. 24, 2018

(65) Prior Publication Data

US 2019/0093268 A1 Mar. 28, 2019

(30) Foreign Application Priority Data

Sep. 28, 2017 (JP) ..... 2017-187458

(51) Int. Cl.
*D05C 9/04* (2006.01)
*D05C 5/02* (2006.01)

(52) U.S. Cl.
CPC ..... *D05C 9/04* (2013.01); *D05C 5/02* (2013.01); *D05D 2205/18* (2013.01)

(58) Field of Classification Search
CPC ... D05C 9/04; D05C 9/06; D05C 9/10; D05C 9/12; D05C 9/14; D05C 9/16
USPC ..... 112/103
See application file for complete search history.

(56) References Cited

U.S. PATENT DOCUMENTS 5,992,339 A * 11/1999 Mack ..... D05C 9/04 112/103
6,095,068 A * 8/2000 Hori ..... D05C 9/04 112/103
6,336,416 B1 * 1/2002 French ..... D05C 9/04 112/103
7,100,523 B2 * 9/2006 Terao ..... D05C 9/04 112/103
7,966,957 B2 * 6/2011 Mack ..... D05C 9/04 112/103
8,651,034 B2 * 2/2014 Taguchi ..... D05C 9/04 112/103

(Continued)

FOREIGN PATENT DOCUMENTS

EP 2818589 A1 * 12/2014 ..... D05B 21/00
JP 2005-146460 A 6/2005

(Continued)

*Primary Examiner* — Danny Worrell
(74) *Attorney, Agent, or Firm* — Oliff PLC

(57) ABSTRACT

A frame holding device holds an embroidery frame provided with a first frame and a second frame. The second frame includes a mounting portion. The frame holding device includes a fixing portion, a base portion, an engaging portion, and a regulation portion. The base portion is connected to the fixing portion. The base portion extends in a first direction and includes a placement surface. The engaging portion is configured to engage with an engaged portion provided on the mounting portion. The regulation portion is configured to restrict the second frame from moving in a third direction by coming into contact with the mounting portion in a state in which the engaged portion and the engaging portion are engaged with each other. The third direction is a direction intersecting with the first direction and the placement surface.

17 Claims, 15 Drawing Sheets

(56) References Cited

U.S. PATENT DOCUMENTS

| | | | | |
|---|---|---|---|---|
| 8,739,710 | B1 * | 6/2014 | Taylor | D05C 9/04 112/103 |
| 9,476,150 | B2 * | 10/2016 | Kawaguchi | D05B 19/16 |
| 9,708,738 | B2 * | 7/2017 | Kawaguchi | D05C 9/06 |
| 2007/0277715 | A1 * | 12/2007 | Watanabe | D05C 9/04 112/103 |
| 2018/0320300 | A1 * | 11/2018 | Kawaguchi | D05C 9/04 |
| 2018/0320301 | A1 * | 11/2018 | Kawaguchi | D05C 9/04 |

FOREIGN PATENT DOCUMENTS

| | | | | | |
|---|---|---|---|---|---|
| JP | 2007-300976 | A | | 11/2007 | |
| JP | 2018123445 | A | * | 8/2018 | D05C 9/04 |

* cited by examiner

FRAME HOLDING DEVICE AND EMBROIDERY FRAME SET

CROSS-REFERENCE TO RELATED APPLICATION

This application claims priority to Japanese Patent Application No. 2017-187458 filed on Sep. 28, 2017, the disclosure of which is herein incorporated by reference in its entirety.

BACKGROUND

The present disclosure relates to a frame holding device and an embroidery frame set.

An embroidery frame is known that is provided with a support frame and a presser frame. The support frame and the presser frame clamp a cloth using magnetic force.

SUMMARY

In the known embroidery frame, the presser frame is strongly fixed to the support frame by the magnetic force. Therefore, once the cloth is clamped, an operation to adjust a positional misalignment of the cloth with respect to the embroidery frame may become difficult.

Various embodiments of the general principles described herein provide a frame holding device and an embroidery frame set that are capable of easily adjusting a position of a sewing object when the sewing object is clamped by an embroidery frame.

Embodiments herein provide a frame holding device that holds an embroidery frame of a sewing machine. The frame holding device includes a fixing portion, a base portion, an engaging portion, a regulation portion. The fixing portion is configured to be detachably fixed to a working table. The base portion is connected to the fixing portion. The base portion extends in a first direction toward the fixing portion. The base portion includes a placement surface. The embroidery frame includes a first frame and a second frame. The embroidery frame is configured to hold a sewing object between the first frame and the second frame. The second frame is configured to be placed on the placement surface. The engaging portion is configured to engage with an engaged portion. The engaged portion is provided on a mounting portion. The mounting portion is included in the second frame and is configured to be detachably mounted on the sewing machine. The engaging portion is configured to restrict the second frame placed on the placement surface from moving in the first direction and a second direction after engaging with the engaged portion. The second direction is a direction opposite to the first direction. The regulation portion is provided further to a third direction side than the placement surface. The third direction is a direction intersecting with the first direction and the placement surface. The regulation portion is configured to restrict the second frame from moving in the third direction, by coming into contact, from the third direction, with the mounting portion in a state in which the engaged portion and the engaging portion are engaged with each other.

Embodiments herein provide an embroidery frame set. The embroidery frame set includes the frame holding device and the embroidery frame.

BRIEF DESCRIPTION OF THE DRAWINGS

Embodiments will be described below in detail with reference to the accompanying drawings in which.

DETAILED DESCRIPTION

An embodiment of the present disclosure will be explained with reference to the drawings. In the following explanation, left and right directions, front and rear directions, and up and down directions as indicated by arrows in FIG. 1 to FIG. 15 are used.

Figure 1:
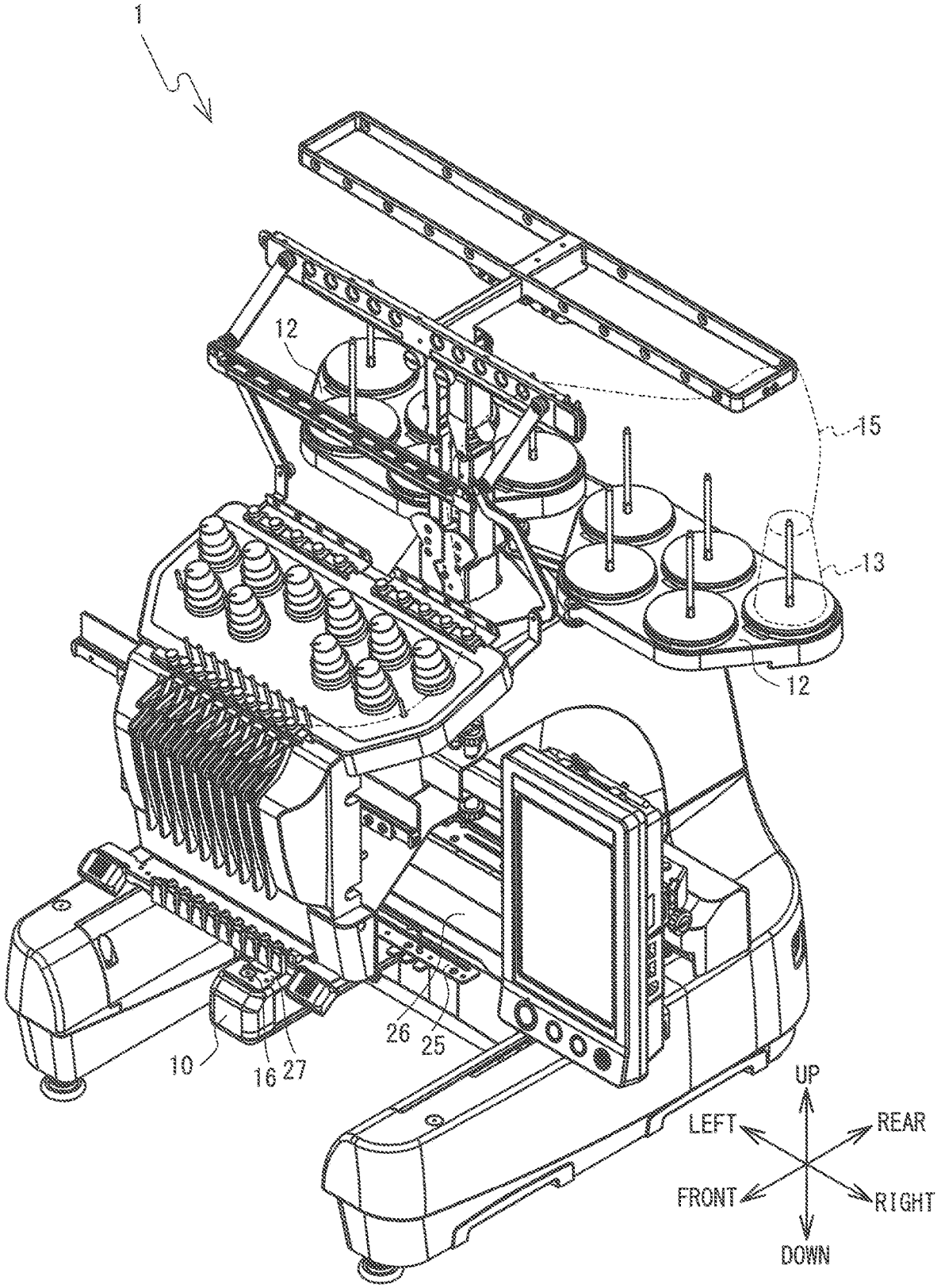
FIG. 1 is a perspective view of a sewing machine 1.
Figure 2:
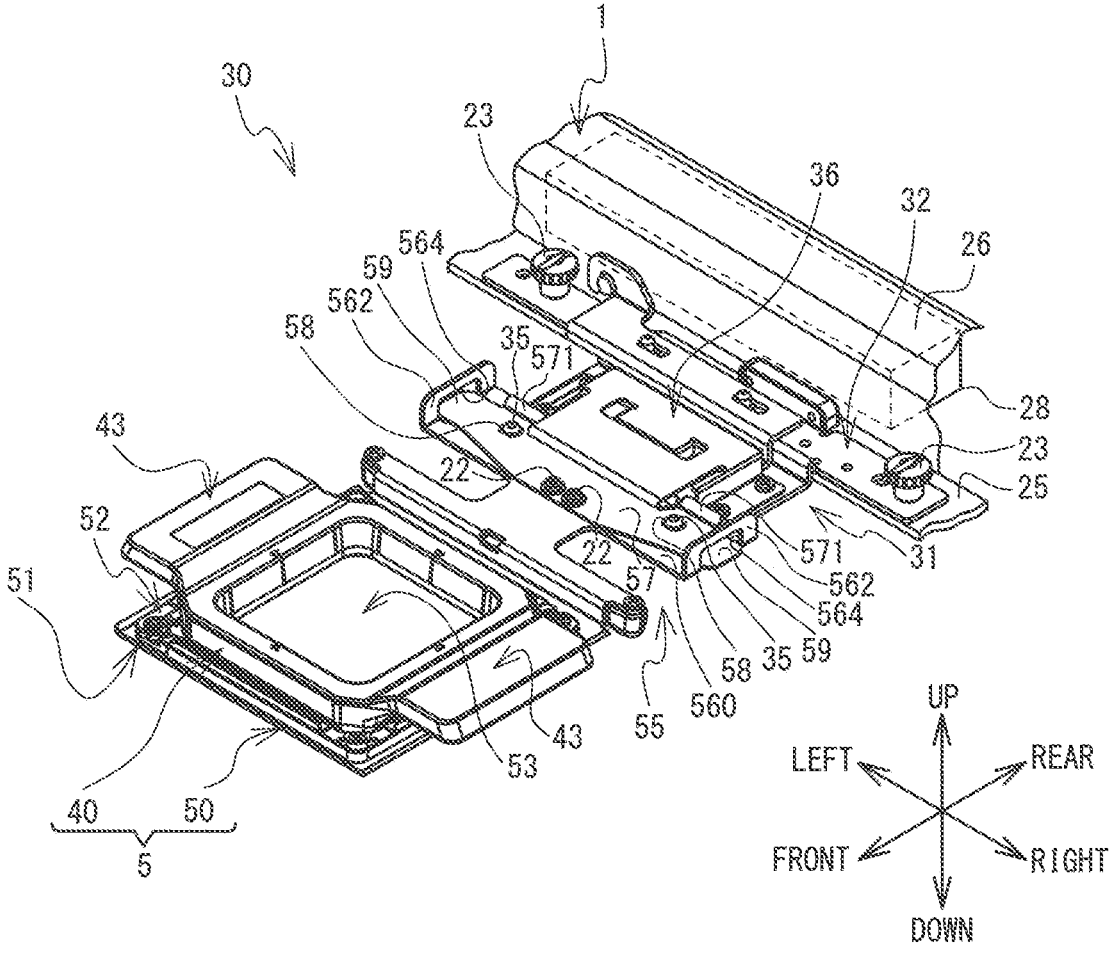
FIG. 2 is a perspective view of an embroidery frame unit 30 mounted on a holder 25 of the sewing machine 1.

The structure of a sewing machine 1 will be explained with reference to FIG. 1 and FIG. 2. The sewing machine 1 shown in FIG. 1 is a multi-needle sewing machine. The sewing machine 1 is provided with ten needle bars (not shown in the drawings). Of the ten needle bars, one needle bar located at a sewing position is a sewing needle bar that is involved in sewing. A sewing needle (not shown in the drawings) is mounted at the lower end of each of the needle bars.

The sewing machine 1 is provided with a cylinder bed 10. The cylinder bed 10 extends in the front-rear direction and is formed in a substantially cylindrical shape. A shuttle (not shown in the drawings) is provided inside a leading end portion of the cylinder bed 10. The shuttle houses a bobbin (not shown in the drawings), around which a lower thread (not shown in the drawings) is wound. A needle plate 27 is provided on the upper surface of the cylinder bed 10. The needle plate 27 is provided with a needle hole 16. The sewing needle can be inserted through the needle hole 16.

A holder 25, a Y carriage 26, an X carriage 28 and the like are provided above the cylinder bed 10. Hereinafter, when the holder 25, the Y carriage 26 and the X carriage 28 are collectively referred to, they are referred to as a movement mechanism. As shown in FIG. 2, the holder 25 supports an embroidery frame 5 via a frame mounting member 31. The embroidery frame 5 clamps a cloth C1 between a first frame 40 and a second frame 50 using magnetic force. The first frame 40 and the second frame 50 will be described later. The movement mechanism can move the embroidery frame 5 mounted on the holder 25 in the front-rear direction and the left-right direction. The sewing machine 1 is provided with a thread spool stand 12. A plurality of thread spools 13 are installed on the thread spool stand 12. Each of upper threads 15 is supplied from each of the plurality of thread spools 13 toward a needle eye (not shown in the drawings) of each of the sewing needles.

The embroidery frame 5 that is holding the cloth C1 is to be mounted on the holder 25 via the frame mounting member 31. The sewing machine 1 drives the sewing needle bar to move up and down and drives the shuttle to rotate while the movement mechanism is moving the embroidery frame 5. Thus, the sewing machine 1 forms stitches on the cloth C1.

Figure 3:
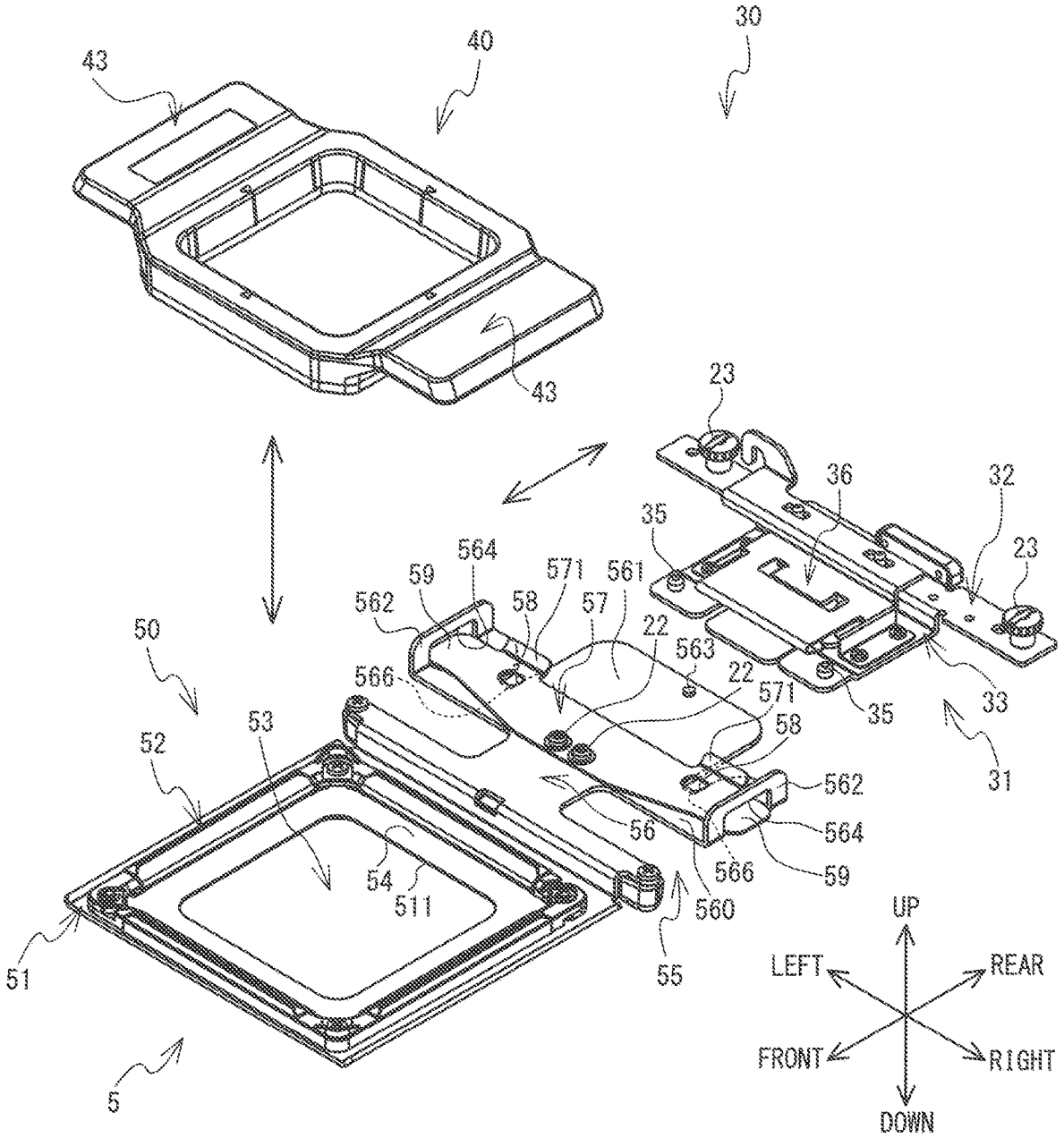
FIG. 3 is an exploded perspective view of the embroidery frame unit 30.
Figure 4:
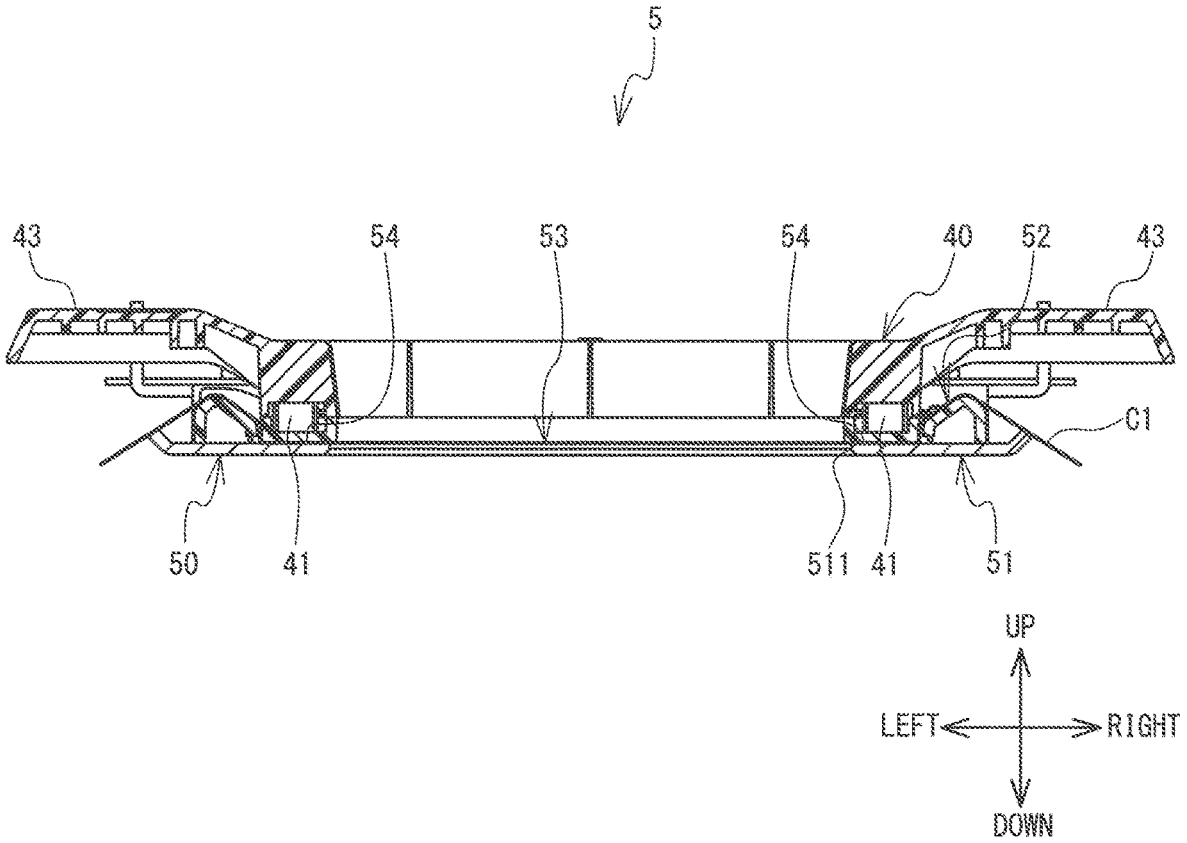
FIG. 4 is a cross-sectional view of the embroidery frame unit 30 that is holding a cloth C1.

The structure of an embroidery frame unit 30 will be explained with reference to FIG. 2 to FIG. 4. As shown in FIG. 3, the embroidery frame unit 30 is provided with the frame mounting member 31 and the embroidery frame 5. The frame mounting member 31 is detachably fixed to the holder 25 of the sewing machine 1 (refer to FIG. 2). The embroidery frame 5 is provided with the first frame 40 and the second frame 50. The embroidery frame 5 can clamp the cloth C1 between the first frame 40 and the second frame 50 using the magnetic force (refer to FIG. 4). A rear portion of the second frame 50 is provided with a mounting portion 55. The mounting portion 55 is detachably mounted on the frame mounting member 31 fixed to the holder 25.

The first frame 40 has an exterior portion that is formed of a non-magnetic material, such as a resin, for example. The first frame 40 has a substantially rectangular shape in a plan view. The first frame 40 is open in the up-down direction, and is positioned above the second frame 50. As shown in FIG. 4, magnets 41 are provided inside the exterior portion of the first frame 40. The magnets 41 are disposed on the bottom surface side of the first frame 40. A pair of left and right grippers 43 are provided on the left and right end portions of the upper surface of the first frame 40. By gripping the pair of grippers 43 with both hands, a user can easily move the first frame 40 in a direction closer to the second frame 50 or a direction separated from the second frame 50.

The second frame 50 has a main body portion 51 and a guide portion 52. The main body portion 51 is a frame member having a substantially rectangular shape in a plan view. The main body portion 51 is formed of a magnetic material (a sheet metal, for example), such as stainless steel. The main body portion 51 has a hole 53 that is open in the up-down direction. The hole 53 has a substantially rectangular shape in a plan view. The upper surface of the main body portion 51 has a clamping surface 54. The clamping surface 54 is a peripheral edge portion of an inner edge 511 of the main body portion 51. The clamping surface 54 extends horizontally, closer to the inner edge 511 side than the guide portion 52. When the cloth C1 is placed on the clamping surface 54, the bottom surface of the first frame 40 is disposed so as to face the clamping surface 54 with the cloth C1 interposed therebetween. In this case, the cloth C1 is clamped between the first frame 40 and the second frame 50 by the magnetic force. The front end portion of an attachment plate portion 56 (to be described later) of the mounting portion 55 is coupled to the rear end portion of the main body portion 51.

The guide portion 52 is provided on an outer edge portion of the clamping surface 54, and can guide the first frame 40 to the clamping surface 54. The guide portion 52 is formed of a non-magnetic material, such as a resin, and is formed in a frame shape having a substantially rectangular shape in a plan view. When the cloth C1 is clamped between the first frame 40 and the second frame 50 by the magnetic force, the clamping surface 54 of the second frame 50 faces a bottom portion of the first frame 40. That is, the first frame 40 is disposed further to the inside than the guide portion 52 (refer to FIG. 2 and FIG. 4).

The mounting portion 55 is provided with the attachment plate portion 56 and a positioning member 57. The attachment plate portion 56 is coupled to the rear end portion of the main body portion 51 of the second frame 50, and extends rearward from the main body portion 51. The attachment plate portion 56 is provided with a lateral portion 560 and a rectangular-shaped portion 561. The lateral portion 560 is formed in a substantially rectangular shape in a plan view, and extends in the left-right direction from substantially the center of the attachment plate portion 56 in the front-rear direction. A pair of insertion portions 562 are provided on the left and right end portions of the lateral portion 560. One of the pair of insertion portions 562 extends upward from one end of the lateral portion 560 in the left-right direction, and the other of the pair of insertion portions 562 extends upward from the other end of the lateral portion 560 in the left-right direction. Each of the insertion portions 562 is provided with a hole 564 that is open in the left-right direction. The rectangular-shaped portion 561 is provided at the rear of the attachment plate portion 56, and is formed in a substantially rectangular shape in a plan view. A convex portion 563 is provided at a central portion, in the left-right direction, of the rear end portion of the upper surface of the rectangular-shaped portion 561. The convex portion 563 protrudes upward. A pair of groove portions 566 that extend in the front-rear direction are provided in sections where the left and right end portions of the rectangular-shaped portion 561 intersect with the rear end portion of the lateral portion 560. The pair of groove portions 566 have a width that allows insertion of a pair of pins 35 (to be described later) of the frame mounting member 31.

The positioning member 57 defines a mounting position of the mounting portion 55 with respect to the frame mounting member 31. The positioning member 57 is a plate spring that extends in the left-right direction. A central portion of the positioning member 57 in the left-right direction is fixed to a central portion of the upper surface of the attachment plate portion 56 in the left-right direction, using a pair of screws 22. The positioning member 57 is provided with a pair of engaged portions 58 and a pair of tab portions 59. The pair of engaged portions 58 are provided on the left end side and the right end side of the positioning member 57. The pair of groove portions 566 provided in the attachment plate portion 56 are positioned directly below the pair of engaged portions 58. The pair of pins 35 (to be described later) of the frame mounting member 31 are inserted into the pair of engaged portions 58 from below. The pair of engaged portions 58 can be engaged with the inserted pair of pins 35. The pair of tab portions 59 are provided on the left and right end portions of the positioning member 57. The pair of tab portions 59 are respectively inserted through the pair of holes 564 of the lateral portion 560. By pressing up the pair of tab portions 59, the user can deflect the left and right end portions of the positioning member 57 upward with respect to the upper surface of the lateral portion 560. A pair of stoppers 571 are provided on the left side and the right side of the rear end portion of the positioning member 57. The pair of stoppers 571 are formed in a substantially rectangular shape in a plan view. Each of the stoppers 571 has a plate shape that is inclined upward and rearward.

The frame mounting member 31 is formed in a substantially T shape in a plan view such that a central portion of the frame mounting member 31 in the left-right direction protrudes forward. The frame mounting member 31 is provided with a fixed portion 32 and a forwardly extending portion 33. The fixed portion 32 is formed in a plate shape that extends in the left-right direction. The fixed portion 32 of the frame mounting member 31 is fixed to the holder 25 using a pair of tab screws 23 (refer to FIG. 2).

The forwardly extending portion 33 extends forward from a substantially central portion of the front end portion of the fixed portion 32. The forwardly extending portion 33 is formed in a substantially rectangular shape in a plan view. The pair of pins 35 are provided on the upper surface of the forwardly extending portion 33. One of the pair of pins 35 is provided at a front right corner portion of the upper surface of the forwardly extending portion 33, and the other of the pair of pins 35 is provided at a front left corner portion of the upper surface of the forwardly extending portion 33. The pins 35 of the present example are pins that protrude upward from the forwardly extending portion 33. The frame mounting member 31 is provided with a pressing member 36 on the upper surface side of the forwardly extending portion 33. In a front view, the pressing member 36 has a substantially inverted U shape that is open downward. In a plan view, the pressing member 36 has a substantially rectangular shape that is long in the left-right direction. The left and right end portions of the pressing member 36 are fixed to the upper surface of the forwardly extending portion 33 using screws. An upper wall portion of the pressing member 36 is provided with a pair of pressing tabs (not shown in the drawings) that protrude downward. On the inside of the pressing member 36, the pair of pressing tabs come into contact with the upper surface of the rectangular-shaped portion 561 of the attachment plate portion 56 and press the upper surface toward the forwardly extending portion 33 side. A plate spring (not shown in the drawings) is provided on the inside of the pressing member 36. The plate spring comes into contact with the rear end portion of the rectangular-shaped portion 561 and urges it forward.

An example of a method for mounting the embroidery frame 5 on the frame mounting member 31 fixed to the holder 25 of the sewing machine 1 will be explained with reference to FIG. 1 to FIG. 3. The user horizontally moves the mounting portion 55 of the embroidery frame 5 rearward toward the frame mounting member 31. At this time, the user lifts the pair of tab portions 59 upward, and causes the left and right end portions of the positioning member 57 to deflect upward. The user inserts the rectangular-shaped portion 561 of the mounting portion 55 between the forwardly extending portion 33 and the pressing member 36, and moves the rectangular-shaped portion 561 rearward. The rectangular-shaped portion 561 moves rearward between the pair of pins 35 provided on the forwardly extending portion 33. The pair of pins 35 are inserted into the pair of groove portions 566 provided in the attachment plate portion 56, and move forward relative to the attachment plate portion 56. The left and right end portions of the positioning member 57 are deflected upward, and therefore, move rearward above the pair of pins 35 without colliding with the pair of pins 35.

The user further moves the embroidery frame 5 rearward. The pair of stoppers 571 provided on the positioning member 57 respectively come into contact with the front end portions of left and right side walls of the pressing member 36 of the frame mounting member 31. Thus, the rearward movement of the attachment plate portion 56 is restricted, and the attachment plate portion 56 is caused to be positioned in the mounting position. At this time, the pair of engaged portions 58 provided on the positioning member 57 are positioned above the pair of pins 35 provided on the forwardly extending portion 33. When the user releases his or her hands from the pair of tab portions 59, the positioning member 57 returns to the original flat plate shape. As a result, the pair of pins 35 and the pair of engaged portions 58 are engaged with each other, and the position of the embroidery frame 5 in the horizontal direction is fixed with respect to the frame mounting member 31. The rectangular-shaped portion 561 of the attachment plate portion 56 is in a state of being inserted inside the pressing member 36. The pair of pressing tabs of the pressing member 36 urge the rectangular-shaped portion 561 of the attachment plate portion 56 toward the forwardly extending portion 33 side (downward). As a result, the attachment plate portion 56 is clamped between the pressing member 36 and the forwardly extending portion 33, and therefore, the position of the attachment plate portion 56 in the up-down direction is fixed. In this manner, the embroidery frame 5 is mounted on the frame mounting member 31 and is attached to the holder 25 of the sewing machine 1.

On the other hand, when the embroidery frame 5 is removed from the frame mounting member 31, the user lifts the tab portions 59 upward. Since the left and right end portions of the positioning member 57 are deflected upward, the pair of engaged portions 58 of the positioning member 57 are disengaged upward from the pair of pins 35. As a result, the attachment plate portion 56 becomes able to move forward. Thus, the user can remove the embroidery frame 5 from the mounting position.

Figure 5:
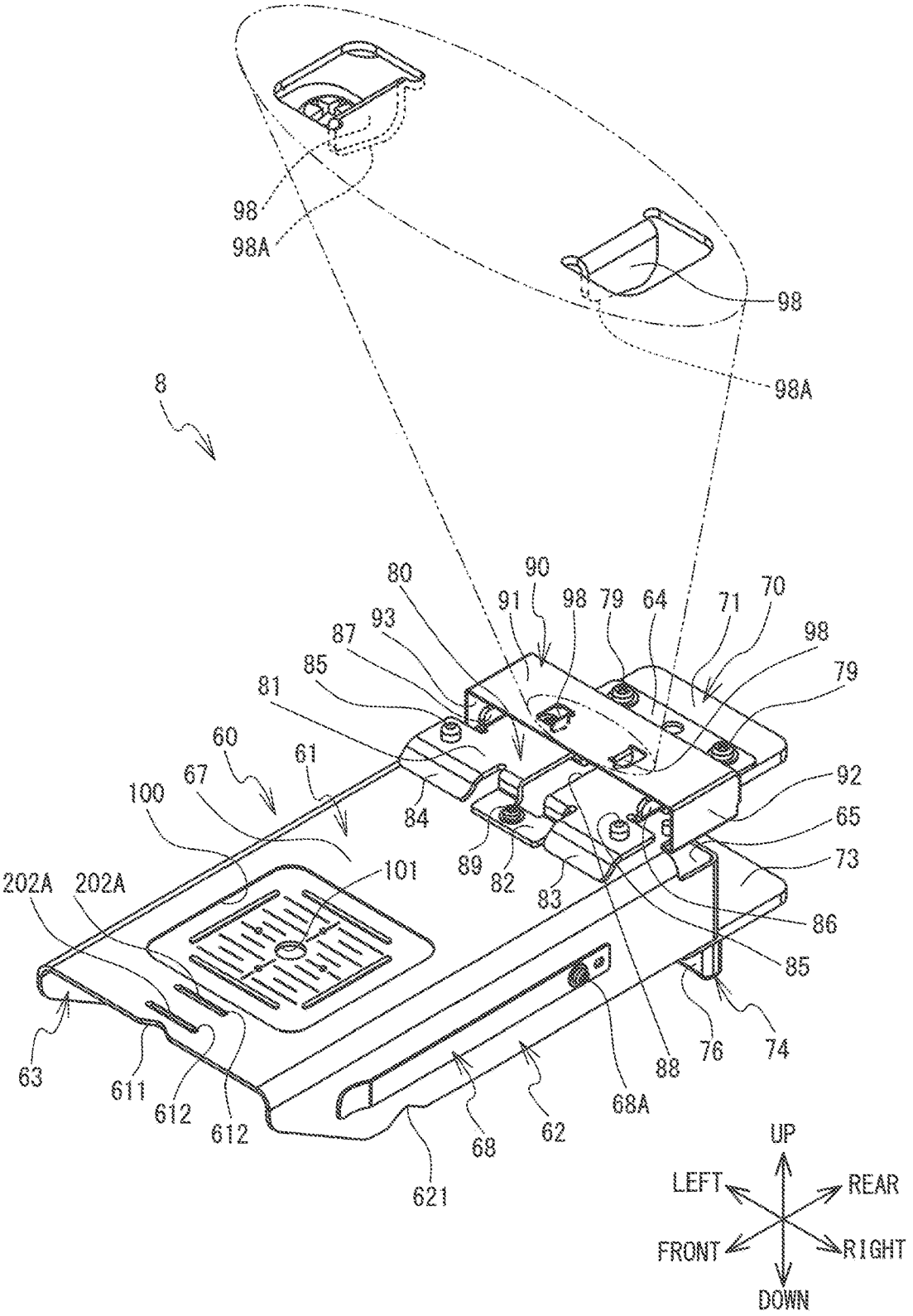
FIG. 5 is a perspective view of a frame holding device 8 when viewed from the front right side.

The structure of the frame holding device 8 will be explained with reference to FIG. 5 to FIG. 11. The frame holding device 8 shown in FIG. 5 is a jig adapted to easy and rapid position adjustment of the cloth C1 with respect to the embroidery frame 5 (refer to FIG. 12 and FIG. 13). In a state in which the frame holding device 8 is fixed to an end portion of a working table T, the frame holding device 8 holds the second frame 50 of the embroidery frame 5 horizontally. Thus, the frame holding device 8 facilitates the easy and rapid position adjustment of the cloth C1.

Figure 6:
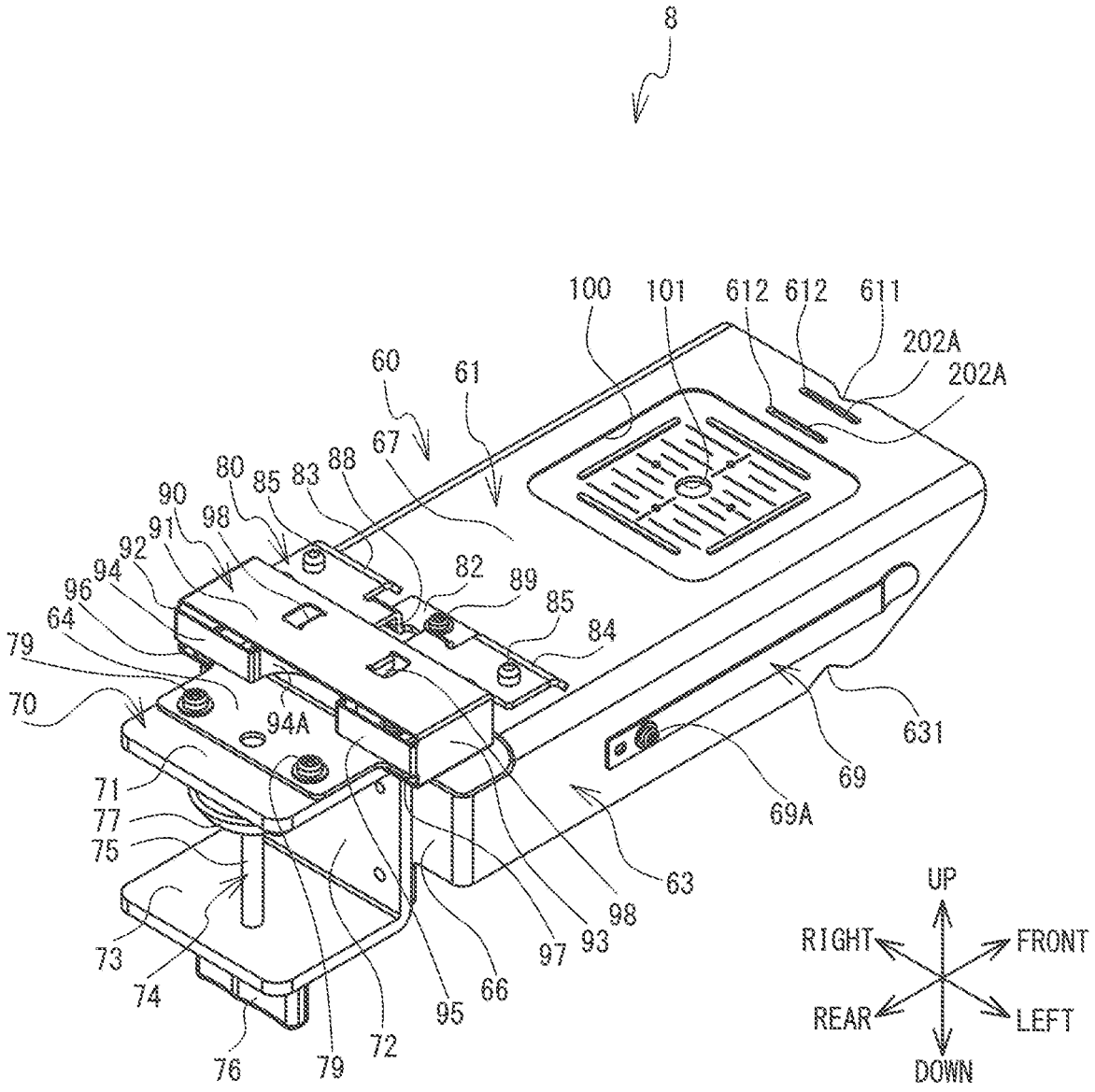
FIG. 6 is a perspective view of the frame holding device 8 when viewed from the rear left side.

As shown in FIG. 5 and FIG. 6, the frame holding device 8 is provided with a base portion 60, a fixing portion 70, a frame mounting portion 80, a regulation portion 90 and the like. The base portion 60 extends in the front-rear direction. The base portion 60 is provided with a placement surface 67 on which the second frame 50 is placed. The fixing portion 70 is detachably fixed to the working table T (refer to FIG. 12). A rear portion of the base portion 60 is connected to the fixing portion 70. The frame mounting portion 80 is provided on the rear side of the placement surface 67, and the mounting portion 55 of the second frame 50 placed on the placement surface 67 is mounted on the frame mounting portion 80. Thus, the frame mounting portion 80 restricts the movement of the second frame 50 in the horizontal direction. The regulation portion 90 is provided so as to cover the frame mounting portion 80. The regulation portion 90 comes into contact with the mounting portion 55 attached to the frame mounting portion 80, from above, and thus restricts the upward movement of the second frame 50.

The structure of the base portion 60 will be explained. In a plan view, the base portion 60 has a substantially rectangular shape that is long in the front-rear direction. In a front view, the base portion 60 has a substantially inverted U shape that is open downward (refer to FIG. 10). The base portion 60 is provided with an upper wall portion 61, a right wall portion 62, a left wall portion 63 and the like.

The upper wall portion 61 is formed in a substantially rectangular plate shape that extends in the front-rear direction and the left-right direction. An upper-side connection piece 64 is provided on the rear end portion of the upper wall portion 61. The upper-side connection piece 64 is formed in a substantially rectangular shape in a plan view, and extends rearward from a substantially central portion of the rear end portion of the upper wall portion 61. The upper-side connection piece 64 is fixed to the upper surface of an upper wall portion 71 (to be described later) of the fixing portion 70, using a pair of screws 79. The placement surface 67 is formed in the upper surface of the upper wall portion 61. The second frame 50 is placed on the placement surface 67. The placement surface 67 can support the second frame 50 substantially horizontally. The lower surface of the upper wall portion 61 is a back surface 61A (refer to FIG. 8). The back surface 61A is a surface of the upper wall portion 61, and is on the opposite side to the placement surface 67.

A concave portion 100 is formed in the front side of the placement surface 67. The concave portion 100 is formed in a substantially rectangular shape in a plan view. An inner bottom surface of the concave portion 100 is a surface that extends horizontally at a position lower than the placement surface 67, and is a predetermined region included in the placement surface 67. The position and the area of the inner bottom surface of the concave portion 100 respectively correspond to the position and the area of the hole 53 of the second frame 50 that has been positioned on the placement surface 67. The area of the concave portion 100 is larger than a sewing range of the sewing machine 1 when the embroidery frame 5 is used. The user can confirm the position of the hole 53 of the second frame 50 by tracing the position of the concave portion 100 with a finger from above the cloth C1, for example. A plurality of indicators are provided on the inner bottom surface of the concave portion 100. The plurality of indicators indicate a center position of the hole 53 of the second frame 50, the front-rear direction and the left-right direction when the center position is used as a reference, the sewing range of the sewing machine 1, and the like.

The plurality of indicators formed on the inner bottom surface of the concave portion 100 will be explained with reference to FIG. 7. The plurality of indicators include a center indicator 101, base lines 121 to 126, and four convex portions 127. The center indicator 101 is provided at a center position of the concave portion 100 in a plan view. The center indicator 101 is, for example, a round hole that is open in the up-down direction. The center indicator 101 is an indicator corresponding to the center position of the hole 53 of the second frame 50 that has been positioned on the placement surface 67. In other words, the center indicator 101 is an indicator corresponding to the center position of the inside of the second frame 50 that has been positioned on the placement surface 67. Therefore, even when the user cannot visually check the position of the hole 53 due to the cloth C1 placed on the second frame 50, by tracing the position of the center indicator 101 with a finger from above the cloth C1, the user can confirm the center position of the hole 53 of the second frame 50 using his or her sense of touch. Note that, instead of the round hole, the center indicator 101 may be a polygonal hole, for example. Further, the center indicator 101 may be formed in any shape, as long as the shape can be recognized by the sense of touch. Therefore, the center indicator 101 may be a non-penetrating hole, and may have a convex shape or a concave shape that is formed by embossing, for example.

The base lines 121 to 124 are provided in the concave portion 100. The base lines 121 to 124 indicate the sewing range of the sewing machine 1. The base lines 121 to 124 are respectively disposed at positions that correspond to four sides of a square centered on the center indicator 101. The base line 121 is disposed to the front of the center indicator 101 and extends in the left-right direction. The base line 122 is disposed to the rear of the center indicator 101 and extends in the left-right direction. The base line 123 is disposed to the right of the center indicator 101 and extends in the front-rear direction. The base line 124 is disposed to the left of the center indicator 101 and extends in the front-rear direction. The base lines 121 to 124 have an embossed shape having a relatively large width, for example. The base lines 121 to 124 are indicators that indicate the front-rear direction and the left-right direction when the center indicator 101 is used as a reference. Therefore, even when the user cannot visually check the position of the hole 53 due to the cloth C1 placed on the second frame 50, by tracing the positions of the base lines 121 to 124 with a finger from above the cloth C1, the user can recognize the sewing range using his or her sense of touch.

The plurality of base lines 125 are provided in a region surrounded by the four base lines 121 to 124 (namely, a region corresponding to the sewing range of the sewing machine 1). The plurality of base lines 125 are provided such that they are aligned at a predetermined interval along the front-rear direction. The predetermined interval is 5 mm, for example. Each of the base lines 125 is formed in a bead shape having a relatively narrow width, and extends in the left-right direction. The plurality of base lines 125 each have a concave shape that is recessed downward. By tracing the positions of the plurality of base lines 125 with a finger from above the cloth C1, the user can confirm the sewing range of the sewing machine 1 using his or her sense of touch. Since each of the base lines 125 is formed in the bead shape having the relatively narrow width, the user can clearly distinguish the base lines 125 from the base lines 121 to 124 by the sense of touch. The plurality of base lines 125 include long base lines and short base lines. The long base lines are longer than the short base lines in the left-right direction. It is preferable that the long base lines and the short base lines be alternately arranged in the front-rear direction, for example. For that reason, an interval between the long base line and the long base line is set to 1 cm, and an interval between the long base line and the short base line is set to 5 mm. Therefore, the user can measure a specific length on the cloth C1. Further, since the plurality of base lines 125 formed on the inside of the concave portion 100 are aligned at the predetermined interval, the user can, for example, visually check the position of the cloth C1 from the base line 121 or the base line 122 (in other words, the position of the cloth C1 from an end portion of the sewing region).

The base line 126 is provided in the region surrounded by the four base lines 121 to 124. The base line 126 passes through the center indicator 101 and extends in the front-rear direction. The base line 126 is formed in a bead shape and has a relatively narrow width. Similarly to the base lines 125, the base line 126 has a concave shape that is recessed downward. The base line 126 is an indicator that causes the user to recognize, using his or her sense of touch, a position at which the sewing range of the sewing machine 1 is divided into a left half and a right half. More specifically, by tracing the position of the base line 126 with a finger from above the cloth C1, the user can confirm the position at which the sewing range is divided into the left half and the right half.

The four convex portions 127 are respectively arranged at positions that are to the front, to the rear, to the left, and to the right of the center indicator 101. The four convex portions 127 are respectively provided on two of the base lines 125 and the base line 126. Specifically, one of the convex portions 127 is provided at an intermediate position of each of the two base lines 125. A pair of the convex portions 127 are provided on the base line 126, with the center indicator 101 being between the pair of convex portions 127. The convex portions 127 protrude upward in a substantially semispherical shape. The four convex portions 127 are indicators that cause the user to recognize, using his or her sense of touch, the front-rear direction and the left-right direction in the sewing range of the sewing machine 1. More specifically, by tracing the position of each of the convex portions 127 with a finger from above the cloth C1, the user can confirm the front-rear direction and the left-right direction in the sewing range.

When the user performs the position adjustment of the cloth C1 with respect to the second frame 50, the user traces each of the above-described indicators with a finger from above the cloth C1. Thus, the user can clearly recognize the position of the cloth C1 with respect to the second frame 50, and a positional relationship between the cloth C1 and the sewing range of the sewing machine 1. Further, in the present embodiment, the shapes of the plurality of indicators formed inside the concave portion 100 are different depending on the position/direction indicated by each of the indicators. Therefore, even when the user cannot recognize one of the indicators using his or her sense of touch due to a material or a thickness of the cloth C1, the user can identify the position/direction indicated by that indicator on the basis of the sense of touch obtained when tracing the other indicators. Therefore, for example, after confirming the center position of the hole 53 of the second frame 50 on the basis of the center indicator 101, the user confirms the front-rear direction and the left-right direction centered on the center indicator 101, on the basis of the base lines 121 to 124. After that, the user can confirm the sewing range of the sewing machine 1 on the basis of the plurality of base lines 125. Thus, the user can perform the position adjustment of the cloth C1 in a good order.

Figure 7:
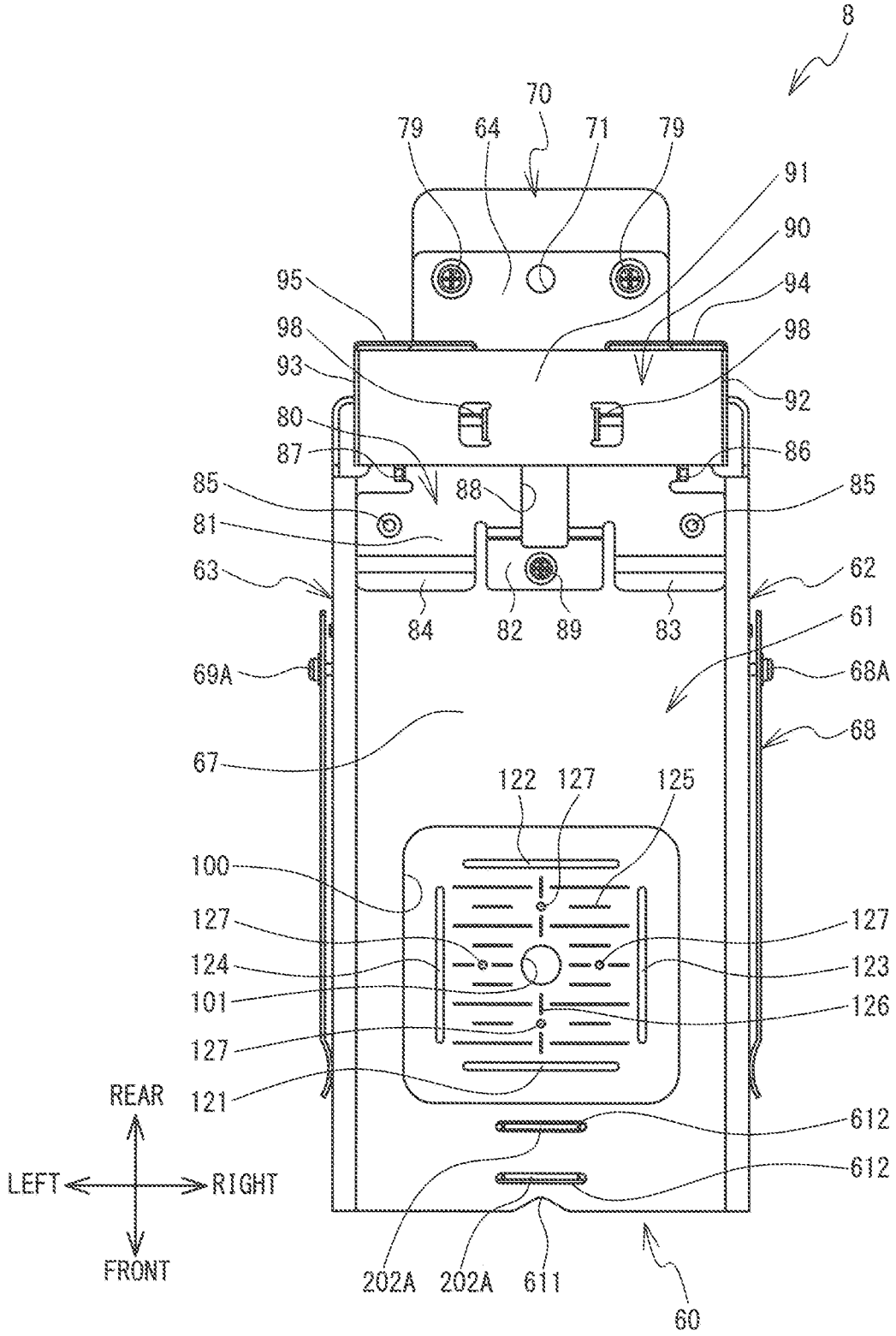
FIG. 7 is a plan view of the frame holding device 8.
Figure 8:
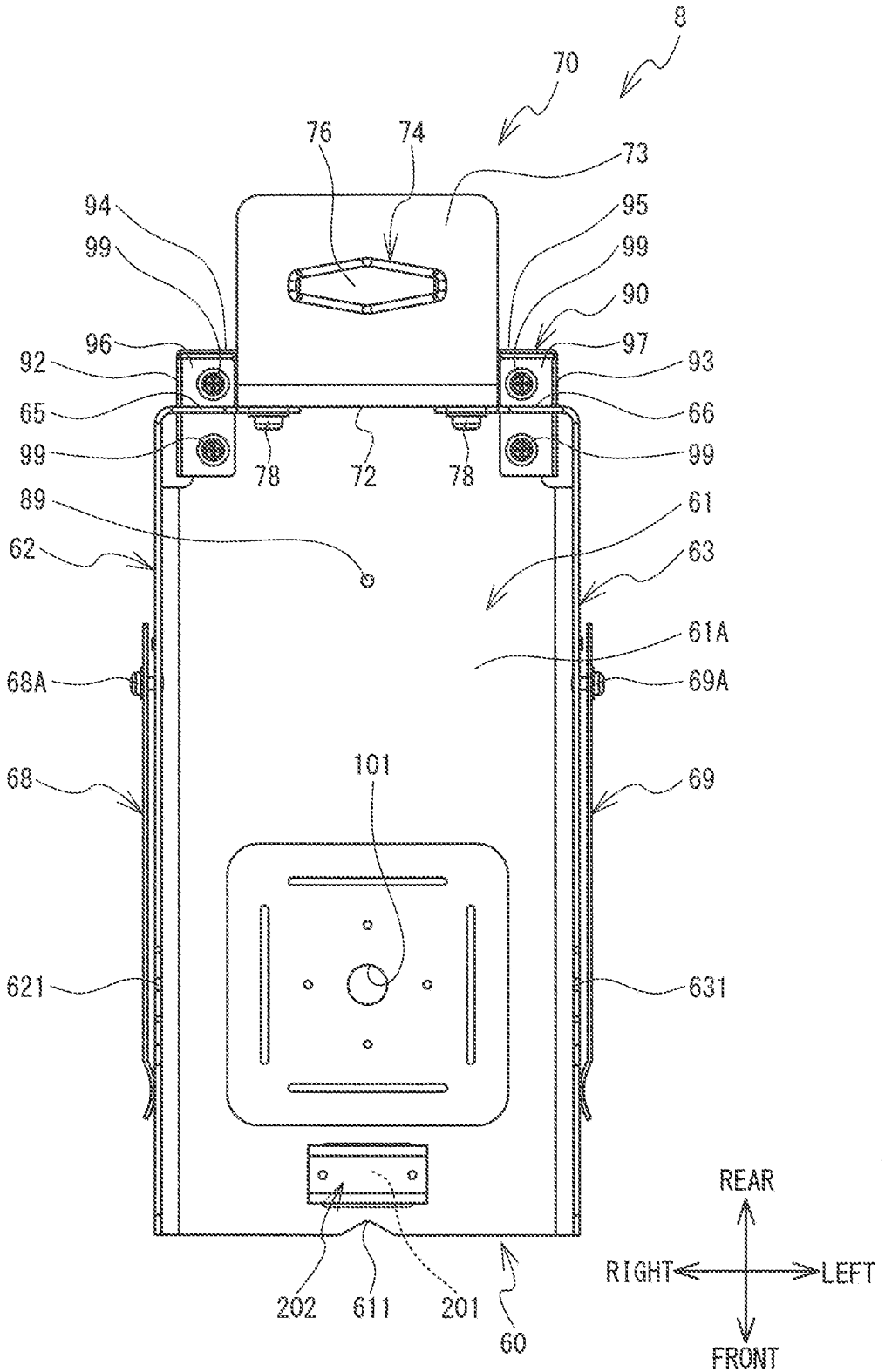
FIG. 8 is a bottom view of the frame holding device 8.

As shown in FIG. 5 and FIG. 7, a guide indicator 611 is provided at a central portion of the front end portion of the upper wall portion 61. The guide indicator 611 is a cut-out portion that is formed in a substantially V shape in a plan view. The guide indicator 611 is provided in the front end portion of the upper wall portion 61, at a position to the front of the center indicator 101 provided inside the concave portion 100. More specifically, the guide indicator 611 is provided in the end portion on the forward direction side of the upper wall portion 61, at a position of the center indicator 101 in the left-right direction. Therefore, the guide indicator 611 indicates the position, in the left-right direction, of the center indicator 101 in the placement surface 67. Therefore, by tracing the position of the guide indicator 611 with a finger from above the cloth C1, the user can identify the position, in the left-right direction, of the center indicator 101 in the placement surface 67. Thus, the user can rapidly find the center indicator 101.

A pair of hole portions 612 that are aligned in the front-rear direction are provided at a substantially central portion of the upper wall portion 61 in the left-right direction, and to the front of the concave portion 100. The pair of hole portions 612 are slits that extend in the left-right direction and are open in the up-down direction. A yoke 202 is fixed to a section of the back surface 61A of the upper wall portion 61, the section corresponding to the pair of hole portions 612 (refer to FIG. 8). The yoke 202 is a magnetic body formed in a substantially U shape in a side view, and a specific magnet 201 is fixed to the inside thereof. The yoke 202 conducts a magnetic flux of the specific magnet 201 in a predetermined direction. The yoke 202 is fixed to the lower surface of the upper wall portion 61 in a state in which the specific magnet 201 fixed inside the yoke 202 is exposed upward. A pair of end portions of the yoke 202 in the left-right direction extend upward. The pair of end portions are inserted into the pair of hole portions 612 from the back surface 61A side toward the placement surface 67 side, and are exposed above the placement surface 67. That is, the upper end portions of the yoke 202 are inserted into the pair of hole portions 612 and are exposed above the placement surface 67. Thus, the second frame 50 placed on the placement surface 67 can be attracted strongly, in comparison to when it is directly attracted to the placement surface 67 side by the specific magnet 201 without using the yoke 202. Note that a height position of the upper end portions of the yoke 202 is the same as or lower than a height position of the placement surface 67.

Figure 9:
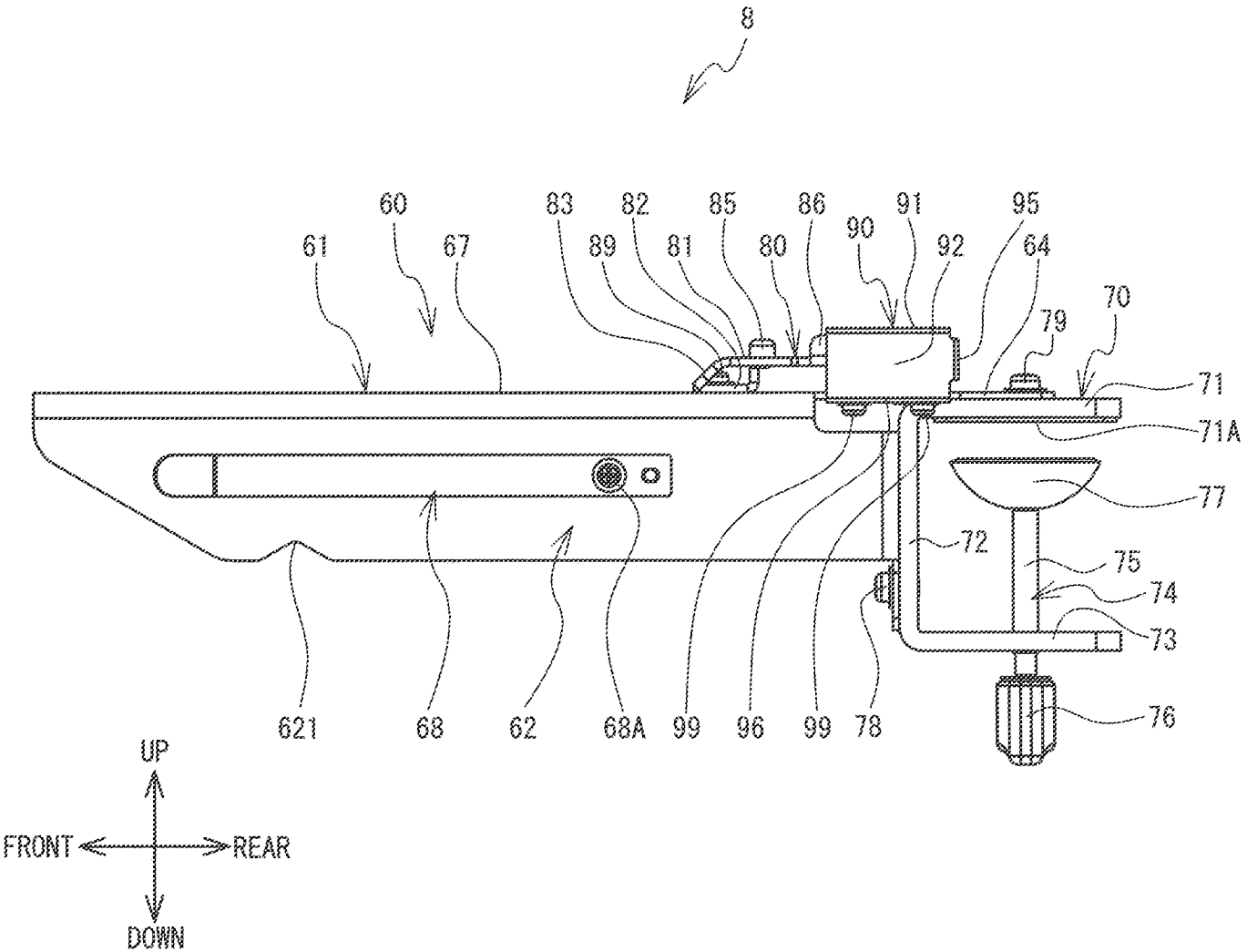
FIG. 9 is a right side view of the frame holding device 8.

As shown in FIG. 5 and FIG. 9, the right wall portion 62 extends downward from the right end portion of the upper wall portion 61. The right wall portion 62 is formed in a substantially rectangular shape that is long in the front-rear direction, in a right side view. A corner portion at which the right wall portion 62 and the upper wall portion 61 are connected to each other is preferably formed in a tapered shape. A lower portion of the front end portion of the right wall portion 62 is formed in a tapered shape that is inclined from the upper front side to the lower rear side. A guide indicator 621 is provided at a front portion of the lower end portion of the right wall portion 62. The guide indicator 621 is a cut-out portion that is formed in a substantially V shape in a right side view. The guide indicator 621 is provided in the lower end portion of the right wall portion 62, at a position to the right of the center indicator 101 of the upper wall portion 61. That is, the guide indicator 621 is provided in the right wall portion 62, at a position of the center indicator 101 in the front-rear direction. Therefore, the guide indicator 621 indicates the position, in the front-rear direction, of the center indicator 101 in the placement surface 67. Therefore, by tracing the position of the guide indicator 621 with a finger from above the cloth C1, the user can identify the position, in the front-rear direction, of the center indicator 101 in the placement surface 67. Thus, the user can rapidly find the center indicator 101.

A presser portion 68 is provided on an outer surface (the right side surface) of the right wall portion 62. The presser portion 68 is a plate spring that extends in the front-rear direction. The rear end portion of the presser portion 68 is fixed by a screw 68A. A front portion of the presser portion 68 can deflect to the right, with the rear end portion of the presser portion 68 serving as a point of support. Therefore, the presser portion 68 can clamp one end portion of the cloth C1 between itself and the outer surface of the right wall portion 62, for example, and can provisionally lock the one end portion of the cloth C1 (refer to FIG. 13).

Figure 10:
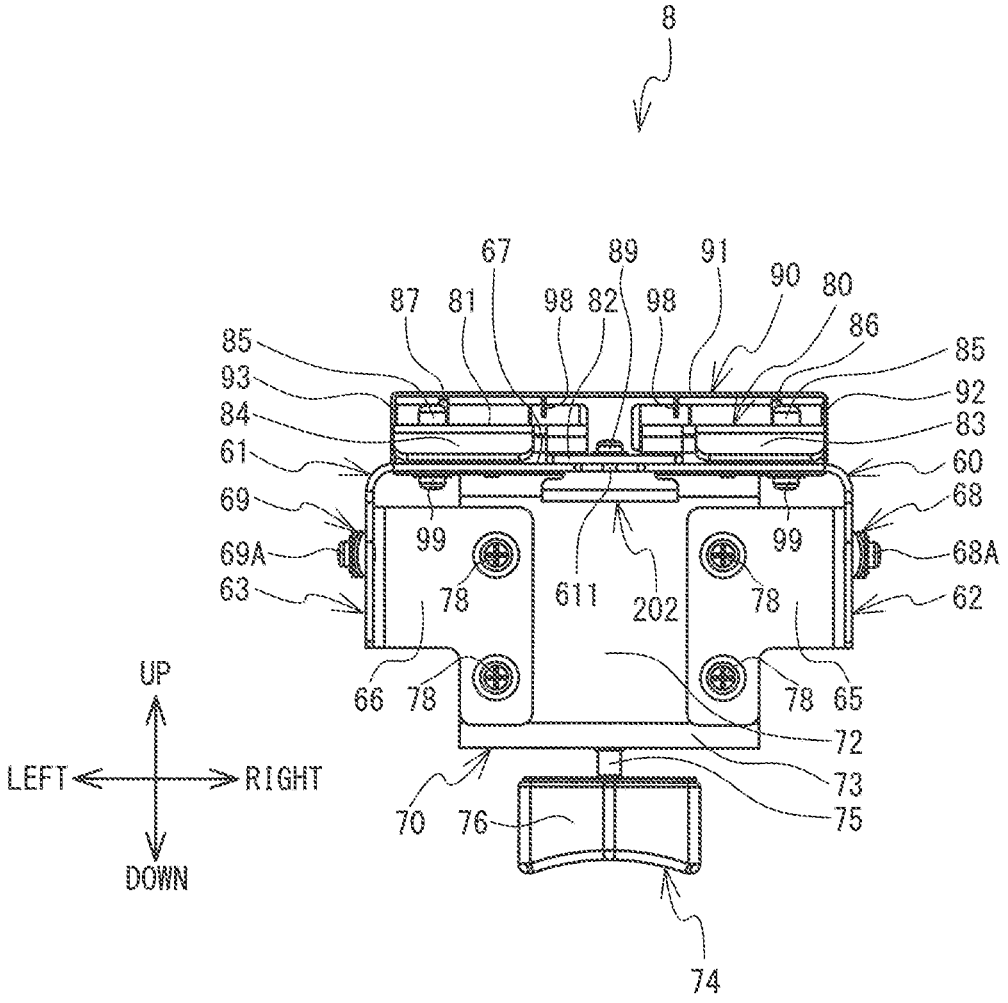
FIG. 10 is a front view of the frame holding device 8.
Figure 11:
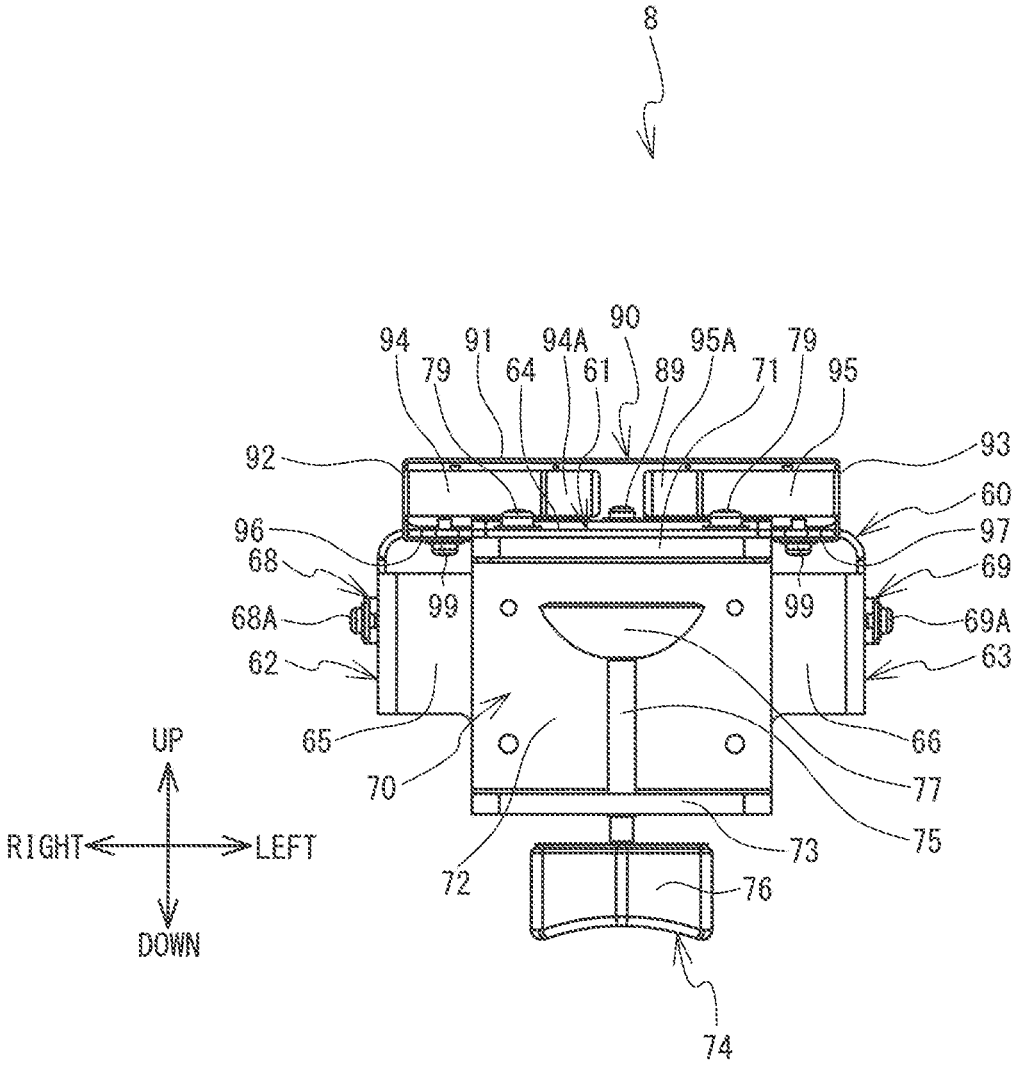
FIG. 11 is a rear view of the frame holding device 8.

A right-side connection piece 65 is provided on the rear end portion of the right wall portion 62 (refer to FIG. 5, FIG. 10 and FIG. 11). The right-side connection piece 65 extends so as to bend to the left from the rear end portion of the right wall portion 62. The right-side connection piece 65 is formed in a substantially inverted L shape in a rear view. The right-side connection piece 65 is connected to a right portion of the front surface of a vertical wall portion 72 (to be described later) of the fixing portion 70, using a pair of screws 78.

As shown in FIG. 6, the left wall portion 63 has a shape that is bilaterally symmetrical with respect to the right wall portion 62. The left wall portion 63 extends downward from the left end portion of the upper wall portion 61. In a left side view, the left wall portion 63 is formed in a substantially rectangular shape that is long in the front-rear direction. A corner portion at which the left wall portion 63 and the upper wall portion 61 are connected to each other is also preferably formed in a tapered shape. When the corner portions at the left and right end portions of the upper wall portion 61 are formed in the tapered shape, the base portion 60 can be easily grasped by a hand. A lower portion of the front end portion of the left wall portion 63 is also formed in a tapered shape that is inclined to the lower rear side from the upper front side. A front-side section of the lower end portion of the left wall portion 63 is provided with a guide indicator 631. The guide indicator 631 is a cut-out portion that is formed in a substantially V shape in a left side view. The guide indicator 631 is provided in the lower end portion of the left wall portion 63, at a position to the left of the center indicator 101 of the upper wall portion 61. More specifically, the guide indicator 631 is provided in the left wall portion 63, at a position of the center indicator 101 in the front-rear direction. Therefore, the guide indicator 631 indicates the position, in the front-rear direction, of the center indicator 101 in the placement surface 67. Therefore, also by tracing the position of the guide indicator 631 with a finger from above the cloth C1, the user can identify the position, in the front-rear direction, of the center indicator 101 in the placement surface 67. Thus, the user can rapidly find the center indicator 101.

A presser portion 69 is also provided on an outer surface (the left side surface) of the left wall portion 63. The presser portion 69 is a plate spring that extends in the front-rear direction. The rear end portion of the presser portion 69 is fixed by a screw 69A. A front portion of the presser portion 69 can deflect to the left, with the rear end portion of the presser portion 69 serving as a point of support. Therefore, the presser portion 69 can clamp the other end portion of the cloth C1 between itself and the outer surface of the left wall portion 63, for example, and can provisionally lock the other end portion of the cloth C1.

A left-side connection piece 66 is provided on the rear end portion of the left wall portion 63 (refer to FIG. 6, FIG. 10 and FIG. 11). The left-side connection piece 66 extends so as to bend to the right from the rear end portion of the left wall portion 63. The left-side connection piece 66 is formed in an inverted L shape in a rear view. The left-side connection piece 66 is connected to a left portion of the front surface of the vertical wall portion 72 (to be described later) of the fixing portion 70, using a pair of the screws 78.

The structure of the fixing portion 70 will be explained. As shown in FIG. 6, FIG. 9 and FIG. 11, the fixing portion 70 is formed in a C shape, in a right side view. The fixing portion 70 is provided with the upper wall portion 71, the vertical wall portion 72, a lower wall portion 73, a fixing tool 74 and the like. The upper wall portion 71 is formed in a substantially rectangular shape in a plan view. The lower surface of the upper-side connection piece 64 of the base portion 60 comes into contact with the upper surface of the upper wall portion 71. The upper-side connection piece 64 is fixed to the upper surface of the upper wall portion 71, using the pair of screws 79 (refer to FIG. 6 and FIG. 7). A cushion member 71A is provided on the lower surface of the upper wall portion 71. The cushion member 71A can come into contact with a contact portion 77 of the fixing tool 74 to be described later. The vertical wall portion 72 extends downward from the front end portion of the upper wall portion 71. The vertical wall portion 72 is formed in a substantially rectangular shape that is vertically long in a front view. The right-side connection piece 65 of the base portion 60 comes into contact with a right portion of the front surface of the vertical wall portion 72. The right-side connection piece 65 is fixed to the vertical wall portion 72, using the pair of screws 78 that are aligned in the up-down direction. The left-side connection piece 66 of the base portion 60 comes into contact with the left side of the front surface of the vertical wall portion 72. The left-side connection piece 66 is fixed to the vertical wall portion 72, using the pair of screws 78 that are aligned in the up-down direction. The lower wall portion 73 extends rearward from the lower end portion of the vertical wall portion 72. The lower wall portion 73 is formed in a substantially rectangular shape in a bottom view (refer to FIG. 8). It is preferable that the distance of separation between the upper wall portion 71 and the lower wall portion 73 in the up-down direction be longer than the thickness of the end portion (refer to FIG. 12) of the working table T that is assumed to be a fixing target. A screw hole (not shown in the drawings) that is open in the up-down direction is provided at substantially the center of the lower wall portion 73.

A shaft portion 75 that extends in the up-down direction of the fixing tool 74 is inserted through and engaged with the screw hole. A thread is formed on the outer peripheral surface of the shaft portion 75. A handle portion 76 is fixed to the lower end portion of the shaft portion 75. The contact portion 77, which has a substantially hemispherical shape and a plate shape, is provided at the upper end portion of the shaft portion 75. The contact portion 77 is open upward. The upper end portion of the contact portion 77 can come into contact with the lower surface of the working table T. By rotating the handle portion 76 of the fixing tool 74, the user can change the position of the fixing tool 74 with respect to the lower wall portion 73. Therefore, the user can adjust the position of the contact portion 77 in the up-down direction. Note that the contact portion 77 may have a substantially flat plate shape.

In the fixing portion 70 having the above-described structure, the height of the contact portion 77 of the fixing tool 74 is adjusted in a state in which the end portion of the working table T is inserted between the upper wall portion 71 and the lower wall portion 73. Thus, the fixing portion 70 can clamp the end portion of the working table T between the upper wall portion 71 and the contact portion 77. In other words, the fixing portion 70 can be strongly fixed to the end portion of the working table T. The fixing portion 70 that has been fixed can be detached from the working table T.

Further, in the base portion 60, the upper-side connection piece 64 is connected to the upper surface of the upper wall portion 71 of the fixing portion 70, and the right-side connection piece 65 and the left-side connection piece 66 are each connected to the front surface of the vertical wall portion 72. For example, the second frame 50 is placed on the placement surface 67 of the base portion 60. There are cases in which the cloth C1 is stretched from above the second frame 50 placed on the placement surface 67. Therefore, in many cases, a relatively large weight load is applied to the placement surface 67. In the present embodiment, even when the relatively large weight load is applied to the base portion 60 from above, the working table T can receive the load via the upper wall portion 71 and the vertical wall portion 72. Therefore, the user can stably perform an operation of stretching the cloth C1 with respect to the second frame 50 placed on the placement surface 67.

The structure of the frame mounting portion 80 will be explained. As shown in FIG. 5 to FIG. 7, the frame mounting portion 80 is provided on the rear end side of the placement surface 67 of the base portion 60. The frame mounting portion 80 is provided with a main body portion 81, a front fixing portion 82, inclined guide portions 83 and 84, a rear support portion (not shown in the drawings), a pair of restriction portions 86 and 87, and the like. The main body portion 81 is formed in a substantially T shape in a plan view. The main body portion 81 is supported such that it is slightly separated from and above the placement surface 67 (refer to FIG. 9). The main body portion 81 is a stepped portion that projects upward. The front fixing portion 82 is provided at a central portion, in the left-right direction, of the front end portion of the main body portion 81. The front fixing portion 82 is formed in a substantially L shape in a side view. The front fixing portion 82 protrudes downward from the front end portion of the main body portion 81, and then bends at a substantially right angle and extends forward. The front end portion of the front fixing portion 82 is fixed to the placement surface 67 of the base portion 60 using a screw 89. The rear support portion is provided on the rear end portion of the main body portion 81. The rear support portion is supported in a state in which the rear end portion of the main body portion 81 is slightly separated from and above the placement surface 67.

The upper surface of the main body portion 81 can support the mounting portion 55 of the second frame 50 from below. One of a pair of engaging portions 85 is provided at a left-side portion of the front portion of the upper surface of the main body portion 81. The other of the pair of engaging portions 85 is provided at a right-side portion of the front portion of the upper surface of the main body portion 81. The shape of the pair of engaging portions 85 and the distance of separation between the pair of engaging portions 85 in the left-right direction are, respectively, the same as the shape of the pair of pins 35 and the distance of separation between the pair of pins 35 in the left-right direction. The pair of engaging portions 85 and the pair of engaged portions 58 provided on the positioning member 57 can be engaged with each other. A long hole 88 is provided in a central portion of the main body portion 81 in the left-right direction. The long hole 88 extends rearward from the downwardly protruding section of the front fixing portion 82.

The inclined guide portions 83 and 84 are respectively provided on the left side and the right side of the front end portion of the main body portion 81. The inclined guide portions 83 and 84 are aligned in the left-right direction, with the front fixing portion 82 being positioned therebetween. The inclined guide portion 83 is disposed to the right of the front fixing portion 82, and the inclined guide portion 84 is disposed to the left of the front fixing portion 82. Each of the inclined guide portions 83 and 84 has a plate shape. Each of the inclined guide portions 83 and 84 is formed in a substantially rectangular shape in a plan view. Each of the inclined guide portions 83 and 84 is inclined diagonally upward from the placement surface 67 toward the upper surface of the main body portion 81. The inclined guide portion 83 is disposed to the front of the right-side engaging portion 85, and the left-side inclined guide portion 84 is disposed to the front of the left-side engaging portion 85. When the second frame 50 is mounted on the frame holding device 8, the inclined guide portions 83 and 84 guide the mounting portion 55 of the second frame 50 rearward toward the upper surface of the main body portion 81.

The pair of restriction portions 86 and 87 are provided on the left and right end portions on the rear end side of the main body portion 81, and are formed in a rib shape so as to protrude upward. The distance of separation between the restriction portions 86 and 87 in the left-right direction is slightly longer than the length of the rectangular-shaped portion 561 of the mounting portion 55 in the left-right direction.

The structure of the regulation portion 90 will be explained. As shown in FIG. 5 to FIG. 7, the regulation portion 90 is provided on the rear end side of the placement surface 67 of the base portion 60. The base portion 60 covers the frame mounting portion 80 from above. It is preferable that the regulation portion 90 be formed by bending a sheet metal, for example. In a plan view, the regulation portion 90 has a substantially rectangular shape that is long in the left-right direction. In a front view, the regulation portion 90 is formed in a substantially inverted U shape that is open downward. The regulation portion 90 is provided with an upper wall portion 91, a right wall portion 92, a left wall portion 93, a right urging portion 94, a left urging portion 95, a right-side fixing portion 96 (refer to FIG. 11), a left-side fixing portion 97 (refer to FIG. 11), and the like.

The upper wall portion 91 is formed in a substantially rectangular plate shape that is long in the left-right direction. The upper wall portion 91 is a plate spring and can deflect in the up-down direction, which is a thickness direction thereof. In summary, the upper wall portion 91 is elastically deformable in the up-down direction. Since the regulation portion 90 is the sheet metal formed by press working, the upper wall portion 91 easily has a plate spring function. The upper wall portion 91 is provided with a pair of contact portions 98 that are aligned in the left-right direction. The contact portions 98 protrude from the upper surface of the upper wall portion 91 toward the placement surface 67 side. It is preferable that the contact portions 98 be formed by a bending process, for example. The lower end portions of the contact portions 98 are inclined portions 98A. The inclined portions 98A are downwardly inclined toward the placement surface 67 side, as they extend rearward. As will be described later, the pair of contact portions 98 come into contact with the upper surface of the rectangular-shaped portion 561 of the mounting portion 55 of the second frame 50 placed on the placement surface 67, and thus inhibit the second frame 50 from floating upward.

The right wall portion 92 extends downward from the right end portion of the upper wall portion 91. The right wall portion 92 has a rectangular shape. The right wall portion 92 is formed in a substantially rectangular shape in a right side view. The left wall portion 93 extends downward from the left end portion of the upper wall portion 91. The left wall portion 93 is formed in a substantially rectangular plate shape in a left side view. The right urging portion 94 is provided so as to extend to the left from the rear end portion of the right wall portion 92. A specific section 94A is provided on the left end portion of the right urging portion 94. The specific section 94A is curved in a substantially arc shape in a plan view such that its front side projects forward. The left urging portion 95 is provided so as to extend to the right from the rear end portion of the left wall portion 93. A specific section 95A is provided on the right end portion of the left urging portion 95. The specific section 95A is also curved in a substantially arc shape in a plan view such that its front side projects forward. When the mounting portion 55 of the second frame 50 is mounted on the frame mounting portion 80, the rear end portion of the rectangular-shaped portion 561 of the mounting portion 55 comes into contact with the forwardly protruding vertex portions of the respective specific sections 94A and 95A. In this way, the right urging portion 94 and the left urging portion 95 urge the rectangular-shaped portion 561 of the mounting portion 55 forward.

The right-side fixing portion 96 bends and extends to the left from the lower end portion of the right wall portion 92. The right-side fixing portion 96 comes into contact with a right section of the rear end portion of the lower surface of the upper wall portion 61, from below. The right-side fixing portion 96 is fixed to the upper wall portion 61 using a pair of screws 99. The left-side fixing portion 97 bends and extends to the right from the lower end portion of the left wall portion 93. The left-side fixing portion 97 comes into contact with a left section of the rear end portion of the lower surface of the upper wall portion 61, from below. The left-side fixing portion 97 is fixed to the upper wall portion 61 using a pair of the screws 99. In this way, the regulation portion 90 is supported on the rear end side of the placement surface 67 such that the regulation portion 90 covers the frame mounting portion 80 from above.

Figure 12:
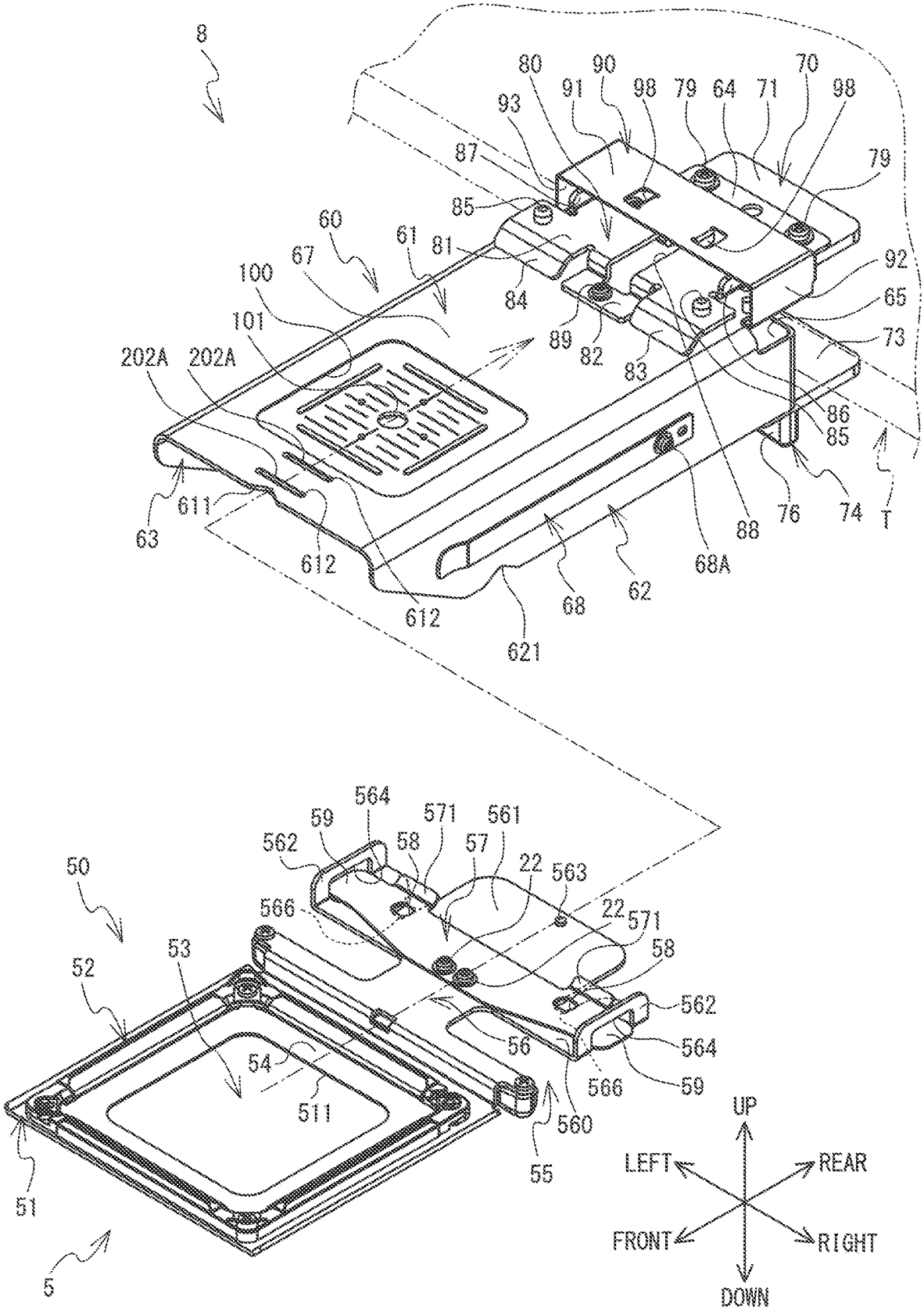
FIG. 12 is a perspective view when a second frame 50 is held by the frame holding device 8.
Figure 13:
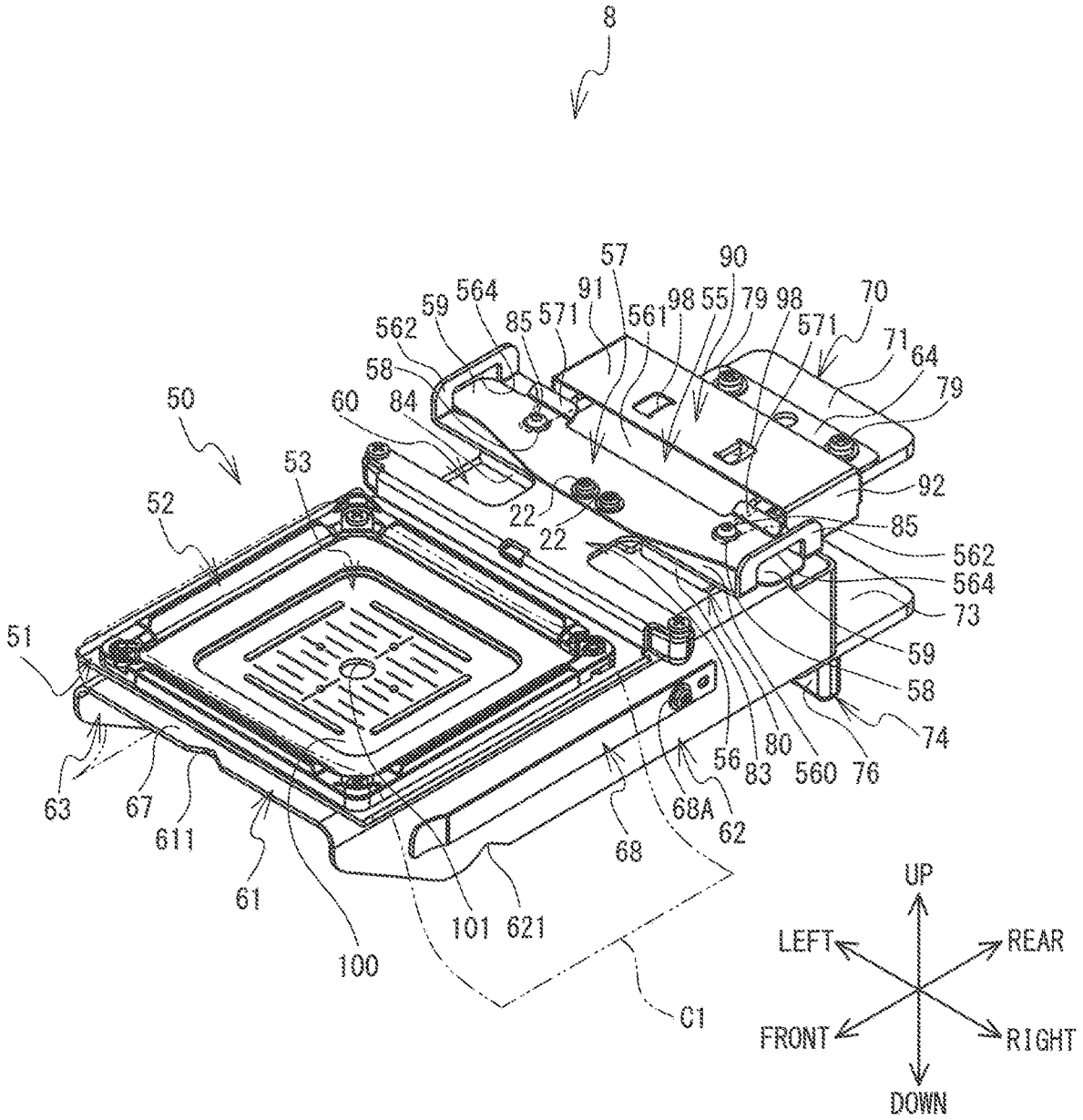
FIG. 13 is a perspective view of the frame holding device 8 that is holding the second frame 50.

An example of a method for causing the frame holding device 8 to hold the second frame 50 will be explained with reference to FIG. 12 and FIG. 13. As shown in FIG. 12, the frame holding device 8 is fixed to the end portion of the working table T in advance by the fixing portion 70. When the frame holding device 8 has been fixed to the working table T, the base portion 60 is supported such that the base portion 60 protrudes forward. The placement surface 67 extends from the front side toward the fixing portion 70 side. The user moves the mounting portion 55 of the embroidery frame 5 rearward along the upper surface of the main body portion 81 of the frame mounting portion 80 of the frame holding device 8. At this time, the user lifts the pair of tab portions 59 upward, and moves the mounting portion 55 rearward while deflecting the left and right end portions of the positioning member 57 upward. At this time, even when the rectangular-shaped portion 561 of the mounting portion 55 moves along the placement surface 67, the rectangular-shaped portion 561 is guided by the inclined guide portions 83 and 84 of the frame mounting portion 80, and thus can ride up over the upper surface of the main body portion 81.

The user causes the rectangular-shaped portion 561 to slip in between the pair of restriction portions 86 and 87. Thus, the restriction portions 86 and 87 guide the rectangular-shaped portion 561 rearward while restricting the movement of the rectangular-shaped portion 561 in the left-right direction. The rectangular-shaped portion 561 is pushed to the inside of the regulation portion 90. The pair of engaged portions 58 provided on the mounting portion 55 are guided toward the pair of engaging portions 85. The pair of engaging portions 85 are inserted into the pair of groove portions 566 provided in the attachment plate portion 56. The pair of engaging portions 85 move forward relative to the attachment plate portion 56. The left and right end portions of the positioning member 57 are deflected upward. Therefore, the left and right end portions of the positioning member 57 move rearward above the pair of engaging portions 85, without colliding with the pair of engaging portions 85. The convex portion 563 is accommodated in the long hole 88 and moves rearward along the long hole 88.

When the embroidery frame 5 further moves rearward, one of the pair of stoppers 571 comes into contact with the front end portion of the restriction portion 86, and the other of the pair of stoppers 571 comes into contact with the front end portion of the restriction portion 87. Thus, the rearward movement of the attachment plate 56 is restricted, and the attachment plate portion 56 is caused to be positioned in the mounting position. At this time, the pair of engaged portions 58 provided on the positioning member 57 are respectively located above the pair of engaging portions 85 provided on the upper surface of the main body portion 81. When the user releases his or her hands from the pair of tab portions 59, the positioning member 57 returns to the original flat plate shape. As a result, as shown in FIG. 13, the pair of engaged portions 58 and the pair of engaging portions 85 are engaged with each other, and the position of the embroidery frame 5 with respect to the frame mounting portion 80 is fixed in the horizontal direction. The specific magnet 201 is attracted to the main body portion 51.

The rectangular-shaped portion 561 is inserted inside the regulation portion 90. The pair of inclined portions 98A come into contact with the upper surface of the rectangular-shaped portion 561 in a well-balanced manner. Thus, the mounting portion 55 of the second frame 50 is inhibited from being displaced upward. Further, the inclined portions 98A are inclined to the placement surface 67 side, as they extend rearward. Therefore, when the mounting portion 55 is mounted on the frame mounting portion 80, even when the rectangular-shaped portion 561 is displaced upward with respect to the pair of contact portions 98, the rectangular-shaped portion 561 is guided to the placement surface 67 side by the inclined portions 98A. Therefore, the upward movement of the rectangular-shaped portion 561 is finally restricted by the contact portions 98. As a result, the attachment plate portion 56 is clamped between the pair of contact portions 98 of the regulation portion 90 and the main body portion 81 of the frame mounting portion 80, and thus the position of the attachment plate portion 56 is fixed in the up-down direction.

When a manufacturing error of the second frame 50 of the embroidery frame 5 is relatively large, the position of the mounting portion 55 when the second frame 50 is placed on the placement surface 67 may be displaced in the up-down direction. The pair of contact portions 98 of the regulation portion 90 are provided on the flexible upper wall portion 91. As a result, in accordance with the displacement of the mounting portion 55, the pair of contact portions 98 can be easily pushed against the mounting portion 55.

On the inside of the regulation portion 90, the forwardly protruding vertex portions of the respective specific sections 94A and 95A come into contact with the rear end portion of the rectangular-shaped portion 561. As a result, the rectangular-shaped portion 561 is held such that it is urged forward by the right urging portion 94 and the left urging portion 95.

Since the mounting portion 55 is mounted on the frame mounting portion 80, the position of the second frame 50 in the horizontal direction and the up-down direction is fixed on the placement surface 67. The second frame 50 that has been positioned on the placement surface 67 is strongly attracted to the placement surface 67 by the magnetic force from a pair of end portions 202A (refer to FIG. 5) of the yoke 202 that are exposed from the pair of hole portions 612. In this manner, the second frame 50 is held on the placement surface 67 of the frame holding device 8. Therefore, when the cloth C1 is stretched over the second frame 50, the frame holding device 8 can inhibit the second frame 50 from unintentionally becoming disengaged from, floating up from, or being displaced from the placement surface 67.

On the other hand, when the second frame 50 (the embroidery frame 5) is removed from the frame holding device 8, the user lifts the tab portions 59 upward. When the tab portions 59 are lifted upward, the left and right end portions of the positioning member 57 are deflected upward, and therefore, the pair of engaged portions 58 disengage upward from the pair of engaging portions 85. As a result, the attachment plate portion 56 becomes able to move forward. Since the rectangular-shaped portion 561 of the attachment plate portion 56 is urged forward by the right urging portion 94 and the left urging portion 95, the rectangular-shaped portion 561 is pushed out toward the front from the inside of the regulation portion 90. By using the forwardly urging force generated by the right urging portion 94 and the left urging portion 95, the user can smoothly move the second frame 50 forward in the horizontal direction. In this way, the user can smoothly remove the embroidery frame 5 from the mounting position. A case can be assumed in which the user removes the pair of engaged portions 58 from the pair of engaging portions 85 by lifting the front end portion of the second frame 50 (the embroidery frame 5) upward, without lifting the tab portions 59 upward. Even in this case, the rectangular-shaped portion 561 is smoothly pushed out toward the front from the inside of the regulation portion 90 by the urging force of the right urging portion 94 and the left urging portion 95. In this way, the rectangular-shaped portion 561 is unlikely to come into contact with the upper wall portion 91 of the regulation portion 90 or a member located in the periphery of the upper wall portion 91. Thus, the second frame 50 and the frame holding device 8 are effectively inhibited from being damaged.

An example of a working method for stretching the cloth C1 over the second frame 50 fixed to the frame holding device 8 will be explained with reference to FIG. 13. Before the cloth C1 is covered over the second frame 50, the concave portion 100 is exposed via the hole 53 of the second frame 50. In a state in which the second frame 50 is held on the placement surface 67 of the frame holding device 8, the user causes the cloth C1 to cover the second frame 50 from above while holding both ends of the cloth C1 with both hands. At this time, it is preferable that the user uses his or her sense of touch to recognize, via the cloth C1, the indicators such as the center indicator 101, the base lines 121 to 126, or the convex portions 127. Thus, the user can perform the position adjustment of the cloth C1 with respect to the second frame 50. At this time, by provisionally holding the left end portion and the right end portion of the cloth C1 using the presser portions 68 and 69, it is possible to temporarily fix the position of the cloth C1. Since the cloth C1 is provisionally held with a relatively light force by the presser portions 68 and 69, the user can easily perform a slight adjustment, such as gradually displacing the position of the cloth C1 with respect to the second frame 50.

After the position of the cloth C1 is determined, the user grips the pair of grippers 43 of the first frame 40 with both hands, and causes the first frame 40 to approach the second frame 50 from above. The first frame 40 is fixed by the magnetic force. As a result, the cloth C1 is clamped between the first frame 40 and the second frame 50. In this way, the second frame 50 is held by the frame holding device 8 and is supported in a horizontal state. Therefore, the user does not need to manually hold the second frame 50. Thus, while gripping the cloth C1, the user can perform the positioning of the cloth C1 with respect to the second frame 50 supported horizontally by the frame holding device 8. Thus, in addition to the capability of performing the position adjustment of the cloth C1 easily and accurately, the slight adjustment of the position of the cloth C1 can also be performed easily. Since the second frame 50 is held by the frame holding device 8, even when the cloth C1 is stretched out again, the user does not need to manually hold the second frame 50. The user grips the pair of grippers 43 of the first frame 40 with both hands, and lifts the rear side of the first frame 40 while using the front side of the first frame 40 as an axis, thus removing the first frame 40. As a result, the upward movement of the second frame 50 is restricted by the regulation portion 90, and the user can easily remove the first frame 40.

Figure 14:
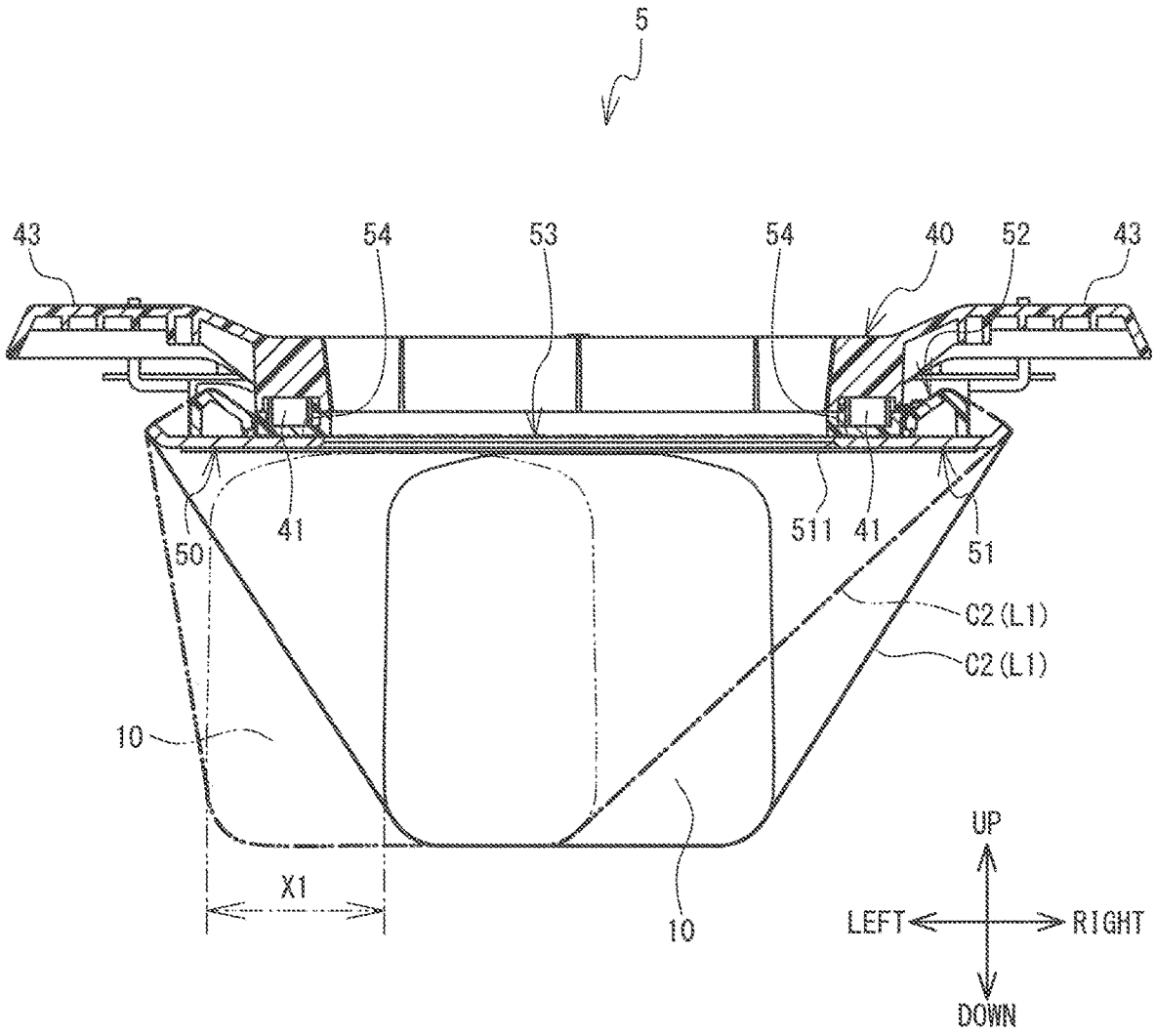
FIG. 14 is a diagram showing a minimum circumferential length L1 of a cylindrical cloth C2 that can be sewn by the sewing machine 1, when the cylindrical cloth C2 is clamped by an embroidery frame 5.

A relationship between a minimum circumferential length L1 of a cylindrical cloth C2 that can be sewn by the sewing machine 1, and a minimum circumferential length L2 of the cylindrical cloth C2 that can be stretched over the second frame 50 using the frame holding device 8 will be explained with reference to FIG. 14 and FIG. 15. The cylindrical cloth C2 is a cylindrical-shaped cloth. The cylindrical cloth C2 is, for example, a sleeve of a shirt, trousers, or the like. The sewing machine 1 can cause the cylindrical cloth C2 to be clamped as a sewing object by the embroidery frame 5, and can sew the clamped cylindrical cloth C2. The embroidery frame 5 that is clamping the cylindrical cloth C2 is mounted on the frame mounting member 31 fixed to the holder 25. At this time, it is necessary to insert the cylinder bed 10 into the inside of the cylindrical cloth C2. For that reason, as shown in FIG. 14, the minimum circumferential length L1 of the cylindrical cloth C2 that can be sewn by the sewing machine 1 is determined taking account of the following two points. The first point is a size of the cylinder bed 10. The second point is a positional relationship between the embroidery frame 5 and the cylinder bed 10 when the embroidery frame 5 has moved in the left-right direction (the X axis direction) with respect to the cylinder bed 10. More specifically, when the embroidery frame 5 moves in the left-right direction (the X axis direction) with respect to the cylinder bed 10, the length by which the cylindrical cloth C2 can move within a movement range X1 in accordance with the position of the cylinder bed 10 is the minimum circumferential length L1 of the cylindrical cloth C2. The movement range X1 is a range in the X axis direction in the sewing range when the sewing is performed using the embroidery frame 5.

A case can be assumed in which the sewing machine 1 sews the cylindrical cloth C2 clamped by the embroidery frame 5 when the user is unaware of the fact that the circumferential length of the cylindrical cloth C2 is smaller than the above-described minimum circumferential length L1. In this case, there is a possibility that a sewing operation may stop as a result of the cylindrical cloth C2 being caught up on the cylinder bed 10 during the sewing operation. Therefore, before the embroidery frame 5 is mounted on the sewing machine 1, the user needs to confirm whether the cylindrical cloth C2 satisfies the minimum circumferential length L1 of the cylindrical cloth C2 that can be sewn by the sewing machine 1. Thus, as shown in FIG. 15, in the present embodiment, the size of the base portion 60 is set such that the minimum circumferential length L2 of the cylindrical cloth C2 that can be stretched over the second frame 50 held on the placement surface 67 is equal to or larger than the minimum circumferential length L1 of the cylindrical cloth C2 that can be sewn by the sewing machine 1.

When the cylindrical cloth C2 is stretched over the second frame 50, it is necessary to insert the base portion 60 into the inside of the cylindrical cloth C2. For that reason, the minimum circumferential length L2 of the cylindrical cloth C2 that can be stretched over the second frame 50 is a minimum circumferential length at which the base portion 60 can be inserted to the inside of the cylindrical cloth C2. In other words, as long as the cylindrical cloth C2 can be stretched over the second frame 50 held by the frame holding device 8, the user can determine that the circumferential length of the cylindrical cloth C2 is equal to or larger than the minimum circumferential length L1 of the cylindrical cloth C2 that can be sewn by the sewing machine 1. Thus, before the cylindrical cloth C2 is mounted on the sewing machine 1, the user can easily determine whether the cylindrical cloth C2 has a cloth shape that can be sewn by the sewing machine 1, by determining whether or not the cylindrical cloth C2 can be stretched over the second frame 50 held by the frame holding device 8.

A positional relationship between the placement surface 67 of the frame holding device 8 and the main body portion 51 of the second frame 50 will be explained with reference to FIG. 13 and FIG. 15. As shown in FIG. 13, when the second frame 50 is placed on the placement surface 67 and the pair of engaging portions 85 engage with the pair of engaged portions 58, the front end portion of the placement surface 67 (the base portion 60) is positioned further to the front than the front end portion of the main body portion 51 of the second frame 50. Thus, when the cloth C1 is placed on the second frame 50, the user can trace the guide indicator 611 with a finger from above the cloth C1. Further, since the frame holding device 8 can stably support the second frame 50 on the placement surface 67, the user can stably perform the operation of stretching the cloth C1 over the second frame 50 from above.

Figure 15:
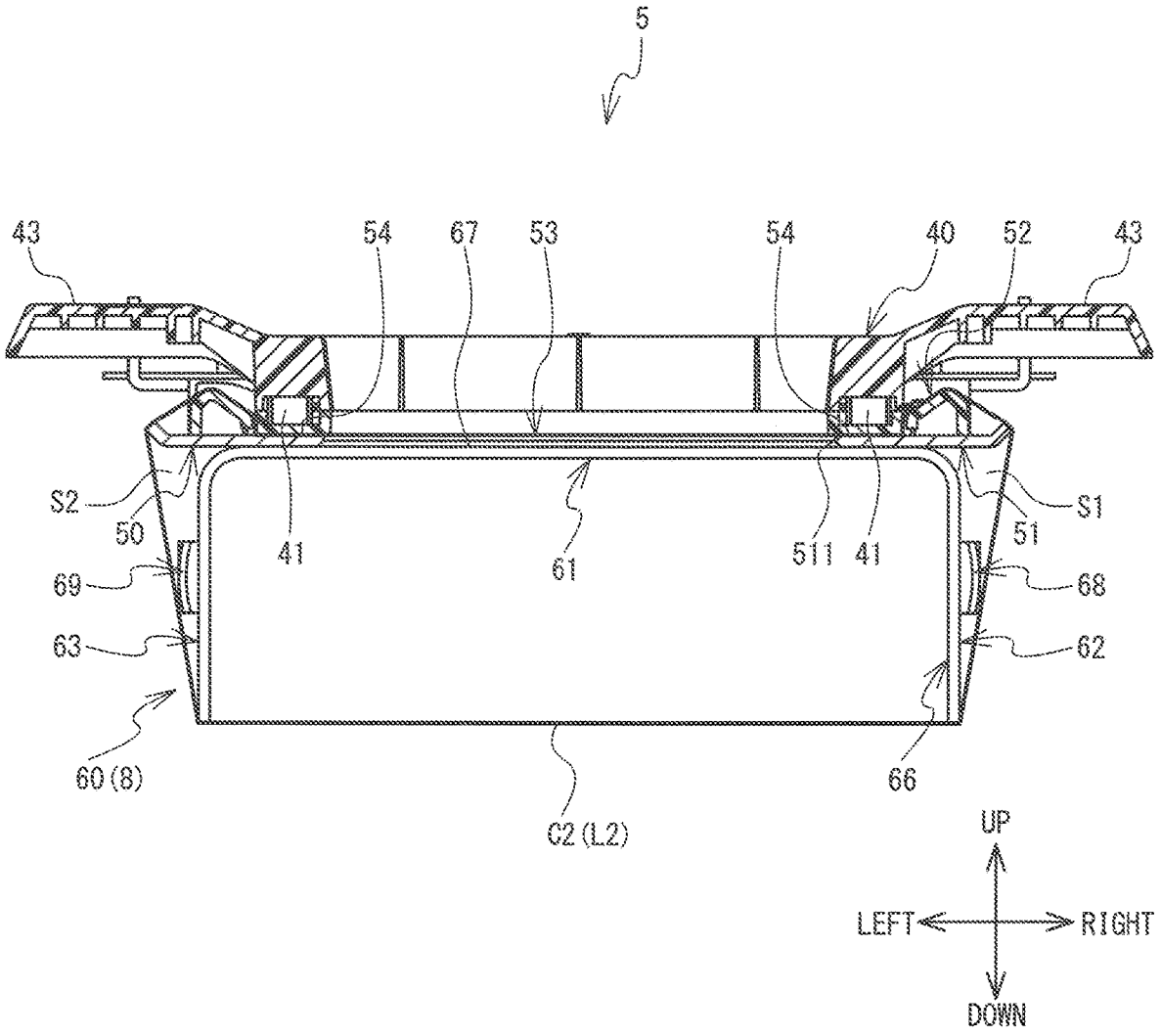
FIG. 15 is a diagram showing a minimum circumferential length L2 of the cylindrical cloth C2 that can be clamped by the embroidery frame 5 held by the frame holding device 8.

Meanwhile, as shown in FIG. 15, the positions of the left end portion and the right end portion of the main body portion 51 of the second frame 50 are positioned further to the outside in the left-right direction than the positions of the left end portion and the right end portion of the base portion 60. More specifically, the length of the main body portion 51 of the second frame 50 in the left-right direction is longer than the length of the base portion 60 in the left-right direction. Thus, for example, when the cylindrical cloth C2 is inserted into the base portion 60 from the front, the user can insert the hands into gaps S1 and S2 and can grasp the cylindrical cloth C2. The gaps S1 and S2 are gaps that occur between the left and right end portions of the main body portion 51 of the second frame 50 and the left and right end portions of the base portion 60. Therefore, the user can easily insert the cylindrical cloth C2 into the base portion 60 while grasping the cylindrical cloth C2 with both hands. Since the positional relationship between the second frame 50 and the base portion 60 is the above-described positional relationship, the frame holding device 8 can inhibit the cylindrical cloth C2 from coming into contact with the presser portions 68 and 69 that are respectively provided on the right wall portion 62 and the left wall portion 63.

The lower portion of the front end portion of each of the right wall portion 62 and the left wall portion 63 has the tapered shape that is inclined downward and rearward from the upper front side. Therefore, the user can easily insert the base portion 60 into the inside of the cylindrical cloth C2. Thus, the frame holding device 8 can improve the workability in stretching the cylindrical cloth C2.

As explained above, the frame holding device 8 of the present embodiment is a jig adapted to hold the embroidery frame 5 that can clamp the cloth C1 between the first frame 40 and the second frame 50 using the magnetic force. The frame holding device 8 is provided with the base portion 60, the fixing portion 70, the frame mounting portion 80 and the regulation portion 90. The base portion 60 has the placement surface 67 on which the second frame 50 is to be placed. The fixing portion 70 is detachably fixed to the working table T. The placement surface 67 of the base portion 60 extends rearward toward the fixing portion 70. The frame mounting portion 80 is provided with the pair of engaging portions 85. The pair of engaging portions 85 engage with the pair of engaged portions 58 provided on the mounting portion 55 of the second frame 50, and the mounting portion 55 is detachably mounted on the sewing machine 1. Since the pair of engaging portions 85 engage with the pair of engaged portions 58, the second frame 50 placed on the placement surface 67 is restricted from moving in the front-rear direction. The regulation portion 90 is provided above the placement surface 67. The regulation portion 90 comes into contact, from above, with the mounting portion 55 in a state in which the pair of engaged portions 58 are engaged with the pair of engaging portions 85, and thereby restricts the upward movement of the second frame 50. In this way, the frame holding device 8 can strongly hold the second frame 50 on the placement surface 67. In the state in which the second frame 50 is strongly held on the placement surface 67 of the frame holding device 8 fixed to the working table T, the user can stretch the cloth C1 over the second frame 50 while holding the cloth C1 with both hands. The user can cause the stretched cloth C1 to be clamped between the first frame 40 and the second frame 50 using the magnetic force. Therefore, the frame holding device 8 can improve the workability in stretching the cloth C1. When the position of the cloth C1 is displaced with respect to the second frame 50, the user can remove the first frame 40 in the state in which the second frame 50 is held by the frame holding device 8. Therefore, the user can also perform the slight adjustment of the position of the cloth C1 easily.

Various modifications can be made to the above embodiment. For example, the following modifications may be added as appropriate. The structure of each of the embroidery frame 5, the embroidery frame unit 30 and the sewing machine 1 may be changed as appropriate. It is sufficient that the number of the needle bars provided in the sewing machine 1 be one or more. It is sufficient that at least one type of the embroidery frame can be mounted on the sewing machine 1. The embroidery frame 5 may be configured to be directly mounted on the holder 25 of the sewing machine 1. When the embroidery frame 5 is attached to the sewing machine 1 via the frame mounting member 31, the structure of the frame mounting member 31 may be changed as appropriate. It is sufficient that the mounting portion used to mount the embroidery frame on the sewing machine be coupled to at least one of the first frame and the second frame. The attachment posture of the embroidery frame 5 with respect to the sewing machine 1 may be changed as appropriate. The first frame 40 need not necessarily include the magnets 41 and the second frame 50 need not necessarily include the main body portion 51. In this case, the embroidery frame 5 may be configured to hold the cloth C1 between the first frame 40 and the second frame 50 without using magnetic force.

The size, the planar shape, the thickness and the like of the embroidery frame 5 may be changed as appropriate. The inner edge of each of the first frame 40 and the second frame 50 may have a shape other than a polygonal shape, such as a circular shape, an elliptical shape or the like, in a plan view. When the shape of the inner edge of each of the first frame 40 and the second frame 50 is a polygonal shape in a plan view, the shape of the inner edge may be a shape other than a square shape, such as a triangular shape, a rectangular shape, a pentagonal shape or the like.

The cloth C1 and the cylindrical cloth C2 are an example of the sewing object that can be sewn by the sewing machine 1. As long as the cloth C1 and the cylindrical cloth C2 are a flexible sheet material that can be sewn, the material of the cloth C1 and the cylindrical cloth C2 is not limited. The material of the cloth C1 and the cylindrical cloth C2 may be, for example, a work cloth, leather, a resin sheet or the like. The processing cloth may be a nonwoven fabric. The shape of the sewing object may be changed as appropriate.

The structure of the frame holding device 8 may be changed as appropriate. As long as the base portion 60 is provided with the upper wall portion 61, the right wall portion 62 and the left wall portion 63, the shape of the base portion 60 may be, for example, a cuboid shape, a cylindrical shape, a box shape or the like. The concave portion 100 and each of the above-described indicators provided inside the concave portion 100 may be formed by various methods, and may be formed by half punch processing, for example. The half punch processing can avoid the trouble of having to form the concave portion 100. The convex indicator may be formed by another member being fixed by welding or the like. The center indicator 101 may be formed in a concave-convex shape. The frame holding device 8 need not necessarily include the center indicator 101. In this case, the base portion 60 may include the guide indicators 611, 621 and 631. When the pair of engaged portions 58 and the pair of engaging portions 85 are engaged with each other, the guide indicator 611 indicates the center position of the inside of the second frame 50 in the left-right direction. When the pair of engaged portions 58 and the pair of engaging portions 85 are engaged with each other, each of the guide indicators 621 and 631 indicates the center position of the inside of the second frame 50 in the front-rear direction. The number, the thickness, the length, the arrangement and the like of the base lines, which are the respective indicators, are not limited to those in the above-described embodiment and may be changed as desired. Each of the indicators may have a shape other than the hole and the base line. The base lines 121 to 126 of the above-described embodiment may have a shape that is recessed downward, for example. Note however that, from the viewpoint of easy recognition via the sense of touch by the user, it is preferable that each of the indicators has an upwardly protruding shape. Each of the indicators may be an indicator that can only be recognized by a visual check by the user. However, from the viewpoint of easy identification of the positions of the various types of indicators when the various types of indicators are covered by the cloth C1, it is preferable that the various types of indicators be indicators that can be recognized via the sense of touch by the user. As long as the guide indicators 621 and 631 are located at the positions where they can guide the position of the center indicator 101, they may be provided in any section of the right wall portion 62 and the left wall portion 63. It is sufficient that the guide indicators 611, 621 and 631 have a shape that can be recognized via the sense of touch by the user, and may have a shape that protrudes to the outside, for example. The concave portion 100, the presser portions 68 and 69, the specific magnet 201, the yoke 202, and the pair of hole portions 612 may be omitted as appropriate. The shape and the position of each of the concave portion 100, the presser portions 68 and 69, the specific magnet 201, the yoke 202, and the pair of hole portions 612 can be changed as appropriate. As long as the positions of the hole portions 612 are on the placement surface 67, the hole portions 612 need not necessarily be on the front side.

The structure of the fixing portion 70 may be changed as appropriate. It is sufficient that the fixing portion 70 be configured to be fixed to the end portion of the working table T, and the structure of the fixing portion 70 may be a clip-like structure, for example. The fixing tool 74 may be provided on the upper wall portion 71, instead of being provided on the lower wall portion 73. In this case, a structure that comes into contact with the working table T from above is adopted for the contact portion 77.

The structure of the frame mounting portion 80 may be changed as appropriate. The inclined guide portions 83 and 84 of the frame mounting portion 80 may be omitted as appropriate. Instead of the pair of restriction portions 86 and 87 having the function to guide the rectangular-shaped portion 561 rearward and the restriction function to restrict the rearward movement of the second frame 50 from the mounting position by the pair of restriction portions 86 and 87 coming into contact with the pair of stoppers 571, another member having the restriction function may be provided.

The structure of the regulation portion 90 may be changed as appropriate. Although the pair of contact portions 98 are provided on the upper wall portion 91 of the regulation portion 90, the number of the contact portions 98 may be one, or three or more. Note however that, when the number of the contact portions 98 respectively provided on the right side and the left side of the central portion of the upper wall portion 91 in the left-right direction is the same as each other, the rectangular-shaped portion 561 of the mounting portion 55 can be pressed from above in a well-balanced manner. The contact portions 98 may be fixed to the lower surface of the upper wall portion 91. In this case, the contact portions 98 protrude to the placement surface 67 side from the lower surface of the upper wall portion 91.

The frame holding device 8 of the above-described embodiment can be combined with the embroidery frame 5 or the embroidery frame unit 30 and can be used as an embroidery frame set.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A frame holding device that holds an embroidery frame of a sewing machine, the frame holding device comprising:

a fixing portion configured to be detachably fixed to a working table;

a base portion connected to the fixing portion, the base portion extending in a first direction toward the fixing portion, the base portion including a placement surface, the embroidery frame including a first frame and a second frame, the embroidery frame being configured to hold a sewing object between the first frame and the second frame, and the second frame being configured to be placed on the placement surface;

an engaging portion configured to engage with an engaged portion, the engaged portion being provided on a mounting portion, the mounting portion being included in the second frame and being configured to be detachably mounted on the sewing machine, the engaging portion being configured to restrict the second frame placed on the placement surface from moving in the first direction and a second direction after engaging with the engaged portion, and the second direction being a direction opposite to the first direction; and a regulation portion provided further to a third direction side than the placement surface, the third direction being a direction intersecting with the first direction and the placement surface, and the regulation portion being configured to restrict the second frame from moving in the third direction, by coming into contact, from the third direction, with the mounting portion in a state in which the engaged portion and the engaging portion are engaged with each other.

2. The frame holding device according to claim 1, further comprising:

a specific magnet provided on a back surface of the base portion, the back surface being on an opposite side to the placement surface, and the specific magnet being configured to be attracted to a magnetic body in the state in which the engaged portion and the engaging portion are engaged with each other, the first frame including a magnet, the second frame including the magnetic body, the embroidery frame being configured to clamp the sewing object between the first frame and the second frame using a magnetic force.

3. The frame holding device according to claim 2, further comprising:

a yoke which is attached to the back surface and to which the specific magnet is fixed, wherein an end portion on the third direction side of the yoke is inserted into a hole portion provided in the base portion from the back surface side toward the placement surface side, and is exposed from the placement surface toward the third direction side.

4. The frame holding device according to any one of claim 1, further comprising:

an urging portion provided further to the first direction side than the engaging portion, the urging portion being configured to urge the second frame in the second direction in the state in which the engaged portion and the engaging portion are engaged with each other.

5. The frame holding device according to claim 1, wherein the fixing portion includes a vertical wall portion extending in the third direction, an upper wall portion extending in the first direction from one end portion of the vertical wall portion in the third direction, the upper wall portion being configured to come into contact with an upper surface of the working table, and a clamping portion connected to another end portion that is on an opposite side to the one end portion of the vertical wall portion, the clamping portion being configured to clamp, from below, the working table between the clamping portion and the upper wall portion, and the base portion includes a first connection portion connected to the upper wall portion, and a second connection portion connected to the vertical wall portion.

6. The frame holding device according to claim 1, wherein the regulation portion includes a flat plate portion configured to be elastically deformed, the flat plate portion having a plate shape that extends in a fourth direction, the fourth direction being a direction parallel to the placement surface and being a direction orthogonal to the first direction and the third direction, and a contact portion protruding from the flat plate portion toward the placement surface side, and the contact portion being configured to come into contact with the mounting portion from the third direction.

7. The frame holding device according to claim 1, wherein the regulation portion includes an inclined portion that is inclined toward the placement surface side as the inclined portion extends toward the first direction, the inclined portion being configured to come into contact with the mounting portion.

8. The frame holding device according to claim 1, further comprising:

a guide portion provided further to the first direction side than the engaging portion, and configured to guide the mounting portion of the second frame in the first direction.

9. The frame holding device according to claim 8, further comprising:

a restriction portion provided on an end portion on the second direction side of the guide portion, the guide portion being formed in a plate shape that is parallel to the first direction and being provided at a position at which the mounting portion of the second frame is to be clamped from both sides in a fourth direction, the fourth direction being a direction orthogonal to the first direction and the third direction, and the restriction portion being configured to restrict the movement of the second frame in the first direction, by coming into contact with a stopper provided further to the second direction side of the second frame than the mounting portion.

10. The frame holding device according to claim 1, further comprising:

an inclined guide portion provided further to the second direction side than the engaging portion and inclined from the placement surface toward a stepped portion, the stepped portion being provided further to the third direction side than the placement surface, the engaging portion being provided on the stepped portion, and the inclined guide portion being configured to guide the mounting portion toward the stepped portion side.

11. The frame holding device according to claim 1, wherein the base portion includes an indicator provided in a predetermined region of the placement surface, the indicator being one of a concave portion, a convex portion and a hole portion, the indicator being positioned on the inside of the second frame in a state in which the second frame is placed on the placement surface and the engaged portion and the engaging portion are engaged with each other, and the indicator indicating a reference of an arrangement position of the sewing object with respect to the second frame.

12. The frame holding device according to claim 11, wherein the base portion includes a center indicator provided in the predetermined region, the center indicator indicating a center position of the inside of the second frame when the engaged portion and the engaging portion are engaged with each other.

13. The frame holding device according to claim 1, wherein the base portion includes a main body portion having the placement surface and extending in the first direction, a pair of side portions extending in the first direction, one of the pair of side portions being provided on one end portion in a fourth direction of the main body portion, the other of the pair of side portions being provided on the other end portion in the fourth direction of the main body portion, the fourth direction being a direction orthogonal to the first direction and the third direction, and a guide indicator that is one of a concave portion, a convex portion, a hole portion and a cut-out portion, the guide indicator indicating at least one of a first position and a second position, the first position being a position of a center position of the inside of the second frame in the fourth direction in the state in which the engaged portion and the engaging portion are engaged with each other, and the second position being a position of the inside of the second frame in a direction parallel to the first direction in the state in which the engaged portion and the engaging portion are engaged with each other, on the pair of side portions.

14. The frame holding device according to claim 13, further comprising:

presser portions provided on the pair of side portions and configured to press the sewing object stretched over the second frame.

15. The frame holding device according to claim 1, wherein an end portion of the placement surface in the second direction is positioned further to the second direction side than an end portion of the second frame in the second direction, in a state in which the second frame is placed on the placement surface and the engaged portion and the engaging portion are engaged with each other.

16. The frame holding device according to claim 1, wherein positions of both end portions of the second frame in a fourth direction are positioned further to the outside in the fourth direction than positions of both end portions of the base portion in the fourth direction, in a state in which the second frame is placed on the placement surface and the engaged portion and the engaging portion are engaged with each other, the fourth direction being a direction orthogonal to the first direction and the third direction.

17. An embroidery frame set, comprising:

the frame holding device according to claim 1; and the embroidery frame.

* * * * *